US008611783B2

(12) United States Patent
Onuma et al.

(10) Patent No.: US 8,611,783 B2
(45) Date of Patent: Dec. 17, 2013

(54) INTERLOCK SYSTEM AND IMAGE FORMING APPARATUS INCORPORATING INTERLOCK SYSTEM

(75) Inventors: Sei Onuma, Tokyo (JP); Nobuhiko Kita, Tokyo (JP); Genta Hagiwara, Tokyo (JP); Masafumi Takahira, Tokyo (JP); Haruo Hashimoto, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 435 days.

(21) Appl. No.: 13/016,099

(22) Filed: Jan. 28, 2011

(65) Prior Publication Data

US 2011/0182614 A1 Jul. 28, 2011

(30) Foreign Application Priority Data

Jan. 28, 2010 (JP) ..... 2010-016360

(51) Int. Cl.

| | |
|---|---|
| ***G03G 15/00*** | (2006.01) |
| ***G03G 21/00*** | (2006.01) |
| ***E05D 15/00*** | (2006.01) |
| ***H01H 1/52*** | (2006.01) |

(52) U.S. Cl.

USPC ..... 399/110; 399/124; 200/320; 49/142

(58) Field of Classification Search

USPC ..... 399/107, 110, 124, 380; 200/320; 49/142, 143

See application file for complete search history.

(56) References Cited

U.S. PATENT DOCUMENTS

| | | | |
|---|---|---|---|
| 7,555,244 | B2 | 6/2009 | Idehara et al. |
| 7,580,653 | B2 | 8/2009 | Idehara et al. |
| 7,611,106 | B2 | 11/2009 | Kondo et al. |
| 7,676,176 | B2 | 3/2010 | Fujiwara et al. |
| 7,677,555 | B2 | 3/2010 | Tanaka et al. |
| 7,689,142 | B2 | 3/2010 | Kita et al. |
| 7,706,716 | B2 | 4/2010 | Tada et al. |
| 7,751,749 | B2 | 7/2010 | Idehara et al. |
| 7,835,661 | B2 | 11/2010 | Idehara et al. |
| 7,844,196 | B2 | 11/2010 | Kita et al. |

(Continued)

FOREIGN PATENT DOCUMENTS

| | | |
|---|---|---|
| CN | 1881095 | 12/2006 |
| CN | 102004430 | 4/2011 |

(Continued)

OTHER PUBLICATIONS

Chinese Office Action dated Jun. 5, 2013 issued in corresponding Chinese Application No. 201110035520.2.

*Primary Examiner* — Walter L Lindsay, Jr.
*Assistant Examiner* — Erika J Villaluna
(74) *Attorney, Agent, or Firm* — Harness, Dickey & Pierce, P.L.C.

(57) ABSTRACT

An interlock system includes first and second racks movable in parallel to each other in a longitudinal direction between opening and closing positions in conjunction with opening and closing of the first cover, respectively. A housing is provided to slidably accommodate the first and second racks in the longitudinal direction. A pinion unit is provided and is sandwiched by the first and second racks. The first and second racks have meshing sections respectively meshing with the pinion unit at one side surfaces extending in the longitudinal direction facing each other. The pinion unit slides in the longitudinal direction by a prescribed length in conjunction with movement of at least one of the first and second racks. The interlock switch is turned on and off in accordance with a sliding length of the pinion unit in the longitudinal direction.

12 Claims, 14 Drawing Sheets

(56) References Cited

U.S. PATENT DOCUMENTS

| | | | |
|---|---|---|---|
| 7,852,638 | B2 | 12/2010 | Kondo et al. |
| 7,854,418 | B2 | 12/2010 | Idehara et al. |
| 7,869,750 | B2 | 1/2011 | Hanashima et al. |
| 7,878,725 | B2 | 2/2011 | Ohkubo et al. |
| 7,899,360 | B2 | 3/2011 | Kondo et al. |
| 2006/0280533 | A1 | 12/2006 | Ozawa |
| 2007/0065201 | A1 | 3/2007 | Fujiwara et al. |
| 2007/0110473 | A1 | 5/2007 | Kondo et al. |
| 2007/0110475 | A1 | 5/2007 | Idehara et al. |
| 2007/0166073 | A1 | 7/2007 | Idehara et al. |
| 2007/0246638 | A1 | 10/2007 | Idehara et al. |
| 2008/0006166 | A1 | 1/2008 | Ohkubo et al. |
| 2008/0007935 | A1 | 1/2008 | Kondo et al. |
| 2008/0050146 | A1 | 2/2008 | Kita et al. |
| 2008/0063425 | A1 | 3/2008 | Idehara et al. |
| 2008/0075502 | A1 | 3/2008 | Tada et al. |
| 2008/0226358 | A1 | 9/2008 | Hanashima et al. |
| 2008/0253796 | A1 | 10/2008 | Idehara et al. |
| 2008/0279585 | A1 | 11/2008 | Furuichi et al. |
| 2008/0292356 | A1 | 11/2008 | Furuichi et al. |
| 2009/0022514 | A1 | 1/2009 | Fujiwara et al. |
| 2009/0074446 | A1 | 3/2009 | Idehara et al. |
| 2009/0074456 | A1 | 3/2009 | Tada et al. |
| 2009/0080937 | A1 | 3/2009 | Kita et al. |
| 2009/0110432 | A1 | 4/2009 | Idehara et al. |
| 2009/0121418 | A1 | 5/2009 | Tanaka et al. |
| 2009/0152435 | A1 | 6/2009 | Kondo et al. |
| 2009/0174135 | A1 | 7/2009 | Tanaka et al. |
| 2009/0285588 | A1 | 11/2009 | Furuichi et al. |
| 2009/0302521 | A1 | 12/2009 | Kondo et al. |
| 2009/0315250 | A1 | 12/2009 | Kimura et al. |
| 2010/0061755 | A1 | 3/2010 | Furuichi et al. |
| 2010/0067942 | A1 | 3/2010 | Hagiwara et al. |
| 2011/0052254 | A1 | 3/2011 | Hashimoto |

FOREIGN PATENT DOCUMENTS

| | | |
|---|---|---|
| JP | 05-165267 | 7/1993 |
| JP | 2008-070522 | 3/2008 |
| JP | 2008-225073 | 9/2008 |

(a)

(b)

--Prior Art--

--Prior Art--

INTERLOCK SYSTEM AND IMAGE FORMING APPARATUS INCORPORATING INTERLOCK SYSTEM

CROSS-REFERENCE TO RELATED APPLICATIONS

This application claims priority pursuant to 35 USC §119 to Japanese Patent Application No. 2010-16360, filed on Jan. 28, 2010, the entire contents of which are hereby incorporated by reference herein.

BACKGROUND OF THE INVENTION

1. Field of the Invention

The present invention relates to an interlock system and an image forming apparatus, such as a copier, a printer, a facsimile machine, etc., incorporating the interlock system, and in particular to an interlock system operated in conjunction with opening and closing of a cover provided to an image forming apparatus, and an image forming apparatus incorporating the interlock system.

2. Description of the Background Art

In general, an image forming apparatus includes a component, such as a processing unit, etc., within an apparatus body. Accordingly, when the component is to be replaced, the interior of the image forming apparatus body must necessarily be accessible. Further, when sheet jam occurs in the apparatus body, a user also needs to access the interior of the image forming apparatus to remove the sheet causing the jam.

For that purpose, the image forming apparatus generally includes an openably closable member, such as an exterior cover, a lid, etc., openable with regard to the apparatus body to allow a user to access thereto to replace the component, or remove the jammed sheet.

One complication is that, such an image forming apparatus generally includes an electronic instrument as a load that needs a high voltage, thereby generating heat of high temperature, and which is, exposed when the cover is opened.

To ensure safety of a user even when the cover is opened, the image forming apparatus sometimes includes an interlock system having an interlock switch or the like operating in conjunction with a of the cover. For example, a connection between a power supply and the electronic instrument it supplied with power is cut by the interlock system on an electric circuit when the cover is opened.

Various interlock systems have been proposed as illustrated in FIGS. 21A and 21B.

For example, as shown in FIGS. 21 and 22, a conventional interlock system 110 is included in an image forming apparatus body 100 to detect opening and closing of an upper cover 101 and an exterior cover 102 with an interlock switch 111. Plural strikers 101*a* and 102*a* are provided on the upper cover 101 and the exterior cover 102 to operate the interlock system 110.

Specifically, when the external cover 102 is closed in the interlock system 110, an arm 113 is pressed by the striker 102*a* and moves to the left in the drawing. Further, when the upper cover 101 is closed in addition to the external cover 102, an actuation lever 114 is pressed by a striker 101*a* and moves downward in the drawing. Consequently, a swingable lever 111*a* of the interlock switch 111 is pressed and is turned on by the actuation lever 104. Further, a contact surface of the striker 101*a* contacting the actuation lever 114 is inclined at a prescribed angle (theta) θ, so that the actuation lever 114 can swing counterclockwise in the drawing.

In this way, the opening and closing of both the upper cover 101 and the exterior cover 102 are detected by decreasing the number of separately and independently necessitated interlock switches from two to one.

In such an interlock system, when one of the fixing unit cover and the original document reader cover is opened, the striker lever and the pushing lever operate in conjunction with opening of the two covers and turn on the interlock switch, so that an interlock signal is outputted therefrom in response thereto.

However, when the external cover 102 is opened while the upper cover 101 is closed in the conventional interlock system 110, the actuation lever 114 swings upward being affected by a return reactive force Fa of the swingable lever 111*a* of the interlock switch 111, while the arm 113 moves to the right therein as shown in FIG. 22.

Consequently, pressure applied to the swingable lever 111*a* swings counter clockwise and the interlock switch 111 of the interlock system 110 is turned off.

During the movement of the arm 113 and the actuation lever 114 on an inclination surface of the striker 101*a*, a sliding resistance is created due to an inclination angle θ (theta) of a contact surface between the striker 101*a* and the actuation lever 114 and a friction coefficient μ thereof.

Consequently, the arm 113 cannot be moved a prescribed length simply by the return reactive force Fa of the swingable lever 111*a* due to the above-mentioned sliding resistance. As a result, the arm 113 likely cannot reach a position where the interlock switch 111 is completely turned off.

To make sure that the arm 113 can reach such a position, a bias spring 113*a* may be provided to bias the arm 113 to the right in FIG. 22 by a biasing force Fb.

Thus, when a bias force $F_b$ of the bias spring 113*a* is increased, movement of the arm 113 is ensured. However, when the bias force Fb is excessively increased, it serves as a resistance against a closing of the external cover 102 and increases the force required to close the cover. Further, since a stress caused by the bias spring 113*a* remains even when the external cover 102 is closed, an internal stress (i.e., a residual stress) in a member that engages the bias spring 113*a* increases, so that the member likely deforms due to creep phenomenon.

Accordingly, the bias force Fb needs to be appropriately determined within a narrow prescribed range to ensure appropriate movement of the arm 113 while suppressing an excessive bias force Fb in the conventional interlock system 110.

For that reason, shortage of a return reactive force Fa of the swingable lever 111*a* needs to be compensated considering the inclination angle θ (theta) of the contact surface between the striker 101*a* and the actuation lever 114 and the friction coefficient μ thereof, resulting in increasing cost due to increasing complexity and the need for finer parts tolerance.

SUMMARY OF THE INVENTION

Accordingly, an object of the present invention is to provide a new and novel interlock system for turning on and off an interlock switch in conjunction with opening and closing of first and second covers. Such a new and novel interlock system includes a first rack movable in a longitudinal direction between opening and closing positions in conjunction with opening and closing of the first cover, respectively, a second rack arranged in parallel to the first rack and movable in a longitudinal direction between opening and closing positions in conjunction with opening and closing of the second cover, respectively, and a housing that slidably accommodates the first and second racks in the longitudinal direction.

A pinion unit is provided and is sandwiched by the first and second racks. The first and second racks have meshing sections respectively meshing with the pinion unit at one side surfaces extending in the longitudinal direction facing each other. The pinion unit slides in the longitudinal direction in conjunction with movement of at least one of the first and second racks. The interlock switch is turned on and off in accordance with a sliding length of the pinion unit in the longitudinal direction.

In another embodiment, the pinion unit includes a pinion to mesh with the meshing sections of the first and second racks and a pinion supporter to freely rotatably supporting the pinion. The housing includes a pinion slider to slidably support the pinion supporter in the longitudinal direction.

In yet another embodiment, a first bias member is provided to engage the first rack and the housing and bias the first rack toward the opening position thereof. A second bias member is provided to engage the second rack and the housing and bias the second rack toward the opening position thereof. The first and second racks move against bias forces of the first and second bias members in the longitudinal direction, respectively, when both the first and second covers are closed.

In yet another embodiment, the first and second racks include engaging sections to engage inner wall surfaces of the housing at their opening positions, respectively.

In yet another embodiment, the interlock switch is secured to the housing.

In yet another embodiment, the first and second covers respectively include pressing sections protruding toward an apparatus body. The first and second racks include levers at their one ends in the longitudinal direction to be pressed by the pressing sections of the first and second covers in conjunction with closing of the first and second covers, respectively. The interlock system is operable in conjunction with opening and closing of both the covers on the same plane.

In yet another embodiment, plural pressing sections are provided protruding from the first and second covers, respectively, toward an apparatus body. A rack actuation mechanism is supported by the housing to move one of the first and second racks in the longitudinal direction in conjunction with opening and closing of one of the first and second covers. The rack actuation mechanism includes a cam pressed by the pressing section in conjunction with a closing of one of the first and second covers, and a gear integral with the cam to simultaneously rotate with the cam to move one of the first and second racks in the longitudinal direction when the cam is pressed. A rack actuation use meshing section is provided in one of the first and second racks to mesh with the gear at the other side opposite the one side meshing with the pinion. A lever is provided in the other one of the first and second racks at one end in the longitudinal direction thereof to be pressed by the pressing section in conjunction with a closing of one of the first and second covers. The other one of the first and second racks moves in the longitudinal direction when the lever is pressed. The interlock system is operable in conjunction with opening and closing of the first and second covers on planes perpendicular to each other, respectively.

In yet another embodiment, the interlock switch is turned on by the pinion unit sliding in the longitudinal direction together with the first and second racks when both the first and second covers are closed. The interlock switch is turned off by the pinion unit sliding in the longitudinal direction when any one of the first and second covers opens.

In yet another embodiment, the interlock switch is composed of a micro switch.

In yet another embodiment, the micro switch includes a swingable lever swingable between turn on and off positions when pressed and released by the pinion unit sliding in the longitudinal direction, respectively. Bias forces of the first and second bias members are greater than a retuning force of the swingable lever.

In yet another embodiment, an image forming apparatus comprises plural image bearers, an optical scanner that forms latent images on the plural image bearers by scanning the plural image bearers, separately, and plural developing devices that separately develop and visualize the latent images on the plural image bearers, respectively. A transfer device is provided to transfer the visualized images from the plural image bearers and superimpose the visualized images on a transfer medium. The interlock system is provided, and the first and second covers are openable with regard to the apparatus body.

In another embodiment, a through-hole is formed to permit the pressing section to penetrate into the apparatus body and press the levers when the first and second covers are closed.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
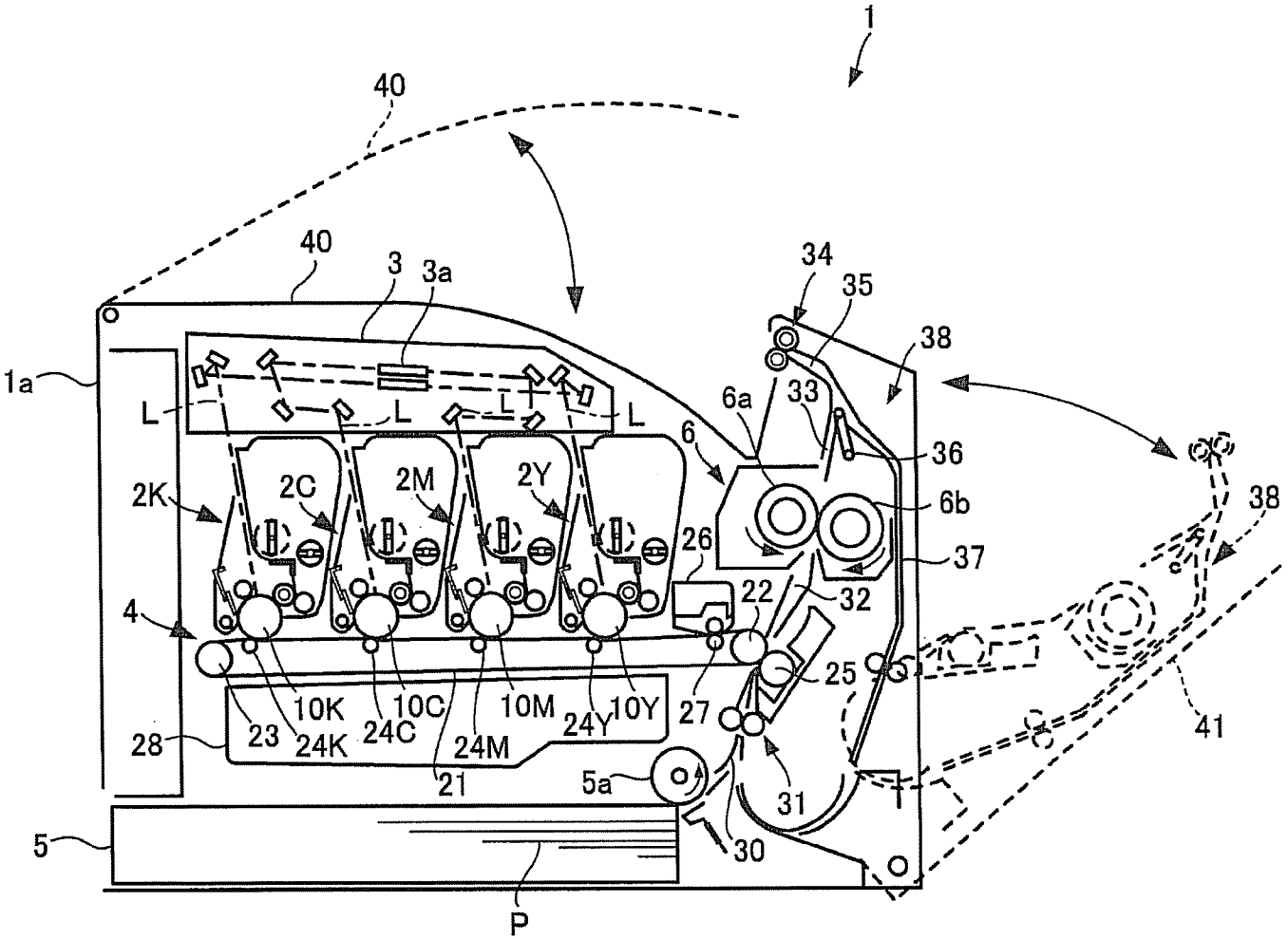
FIG. 1 schematically illustrates an exemplary printer equipped with an interlock system according to a first embodiment of the present invention.

Referring now to the drawing, wherein like reference numerals designate identical or corresponding parts throughout several views, in particular in FIG. 1, a first embodiment of an exemplary image forming apparatus which is applied to a printer that employs an electro-photographic system is hereinafter described.

Although, a full-color printer that uses a general latent image formation manner is described hereinafter, the present invention is not limited thereto, and is applied to another image forming apparatus, such as tan image forming apparatus forming a monochrome image.

Initially, an exemplary configuration of a printer is described with reference to FIG. 1. The printer 1 is composed of process units 2Y to 2K (sometimes referred to simply as a process unit 2), an optical writing unit 3, a transfer unit 4, a sheet feeding cassette 5, and a fixing device 6.

The process units 2Y to 2K have the same configuration except for toner color of Y to K, and thus form toner images of yellow, magenta, cyan, and black, respectively. The process units are replaced when arriving at their end of lives.

Figure 2:
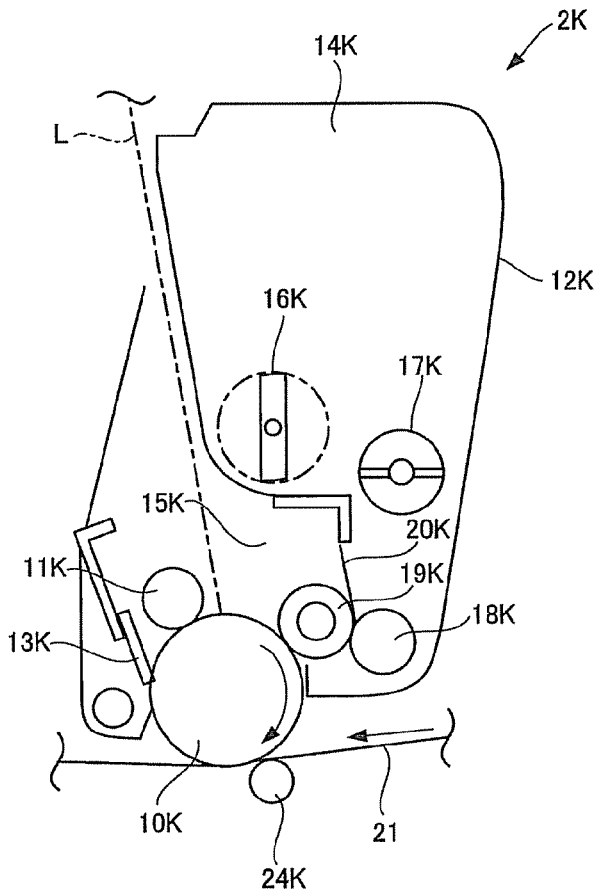
FIG. 2 schematically illustrates a process unit according to the first embodiment of the present invention.

The configuration of the printer is more specifically described herein below only based only on the process unit 2K for a black toner image with reference to FIG. 2.

As shown, the process unit 2K includes a drum state photo-conductive member 10K serving as an image bearer, a charger 11*k*, a developing device 12K, a drum cleaner 13K, and a charge remover, not shown.

The process unit 2K is detachable to an apparatus body 1*a* of the printer 1, and is replaceable as consumption parts all at once.

The photo-conductive member 10K is rotated clockwise in the drawing by a driver, not shown, while a surface thereof is uniformly charged by the charger 11K. The surface of the photo-conductive member 10K with the uniform charge is exposed to a scanning laser light L, so that a K-use latent image is created and carried thereon. Specifically, the charger 11K uniformly charges the surface of the photo-conductive member 10K.

The developing device 12K includes a hopper 14K for storing K-toner, not shown, and a developing section 15K. There are provided in the hopper 14K an agitator 16K driven and rotated by a driver, not shown, a stirring puddle 17K, and toner supply roller 18K. The K-toner in the hopper 14K is enabled to move by its own gravity toward a toner supply roller 18K, while being stirred by rotation of both the agitator 16K and the stirring puddle 17K.

The toner supply roller 18K includes a metal core and a roller sec made of resin or the like overlying the metal core. The toner supply roller 18K rotates and provides the toner in the hopper 14K to the surface of the roller.

There are provided in the developing section 15K a developing roller 19K that rotates and contacts booth the photo-conductive member 10K and the toner supply roller 18K, and a layer thinning blade 20K with its tip contacting a surface of the developing roller 19K. The K-toner attracted to the toner supply roller 18K in the hopper 14K is supplied to a surface of the developing roller 19K at a contact section between the developing roller 19K and the toner supply roller 18K. A layer thickness of the K-toner thus supplied is defined on the surface of the roller when passing through the contact section between the developing roller 19K and the layer thinning blade 20K as the developing roller 19K rotates. The K-toner subjected to the layer thinning process is then attracted to a latent image formed on the surface of the photo-conductive member 11K in a developing region of a contact section arranged between the developing roller 19K and the photo-conductive member 10K. Consequently, a K toner image is formed based on the K use latent image.

The K-toner image is then transferred onto an intermediate transfer belt 21 as mentioned later in detail.

The drum cleaner 13K removes toner remaining on the surface of the photo-conductive member 10K onto the intermediate transfer belt 21 after the transfer process.

The charge remover removes electric charge remaining on the surface of the photo-conductive member 10K after the cleaning process. As a result of such charge removal, the surface of the photo-conductive member 10K is initialized and becomes ready for the next image formation.

Similar image formation processes are executed for forming Y to C toner images on the photo-conductive members 10Y to 10C in the remaining process units 2Y to 2C with the other colors, respectively, so that these toner images are superimposed on the intermediate transfer belt 21.

As shown, the optical writing unit 3 is arranged vertically above the process units 2Y-2K and executes optical scanning on the respective photo-conductive members 10Y to 10K in the process units 2Y to 2K by emitting a laser light L from a laser diode based on image information.

As a result of such optical scanning, latent images for Y to K colors are formed on the respective photo-conductive members 10Y to 10K.

The optical writing unit 3 deflects the laser light L emitted from a light source in a main scanning direction and brings the laser light onto a photo-conductive member via plural optical lenses and mirrors using a polygon mirror 3*a* that is driven rotated by a polygon motor, not shown.

The transfer unit 4 is arranged vertically below the process units 2Y to 2K by including an intermediate transfer belt 21, a driving roller 22, and a driven roller 23. Also included in the transfer unit 4 are four primary rollers 27Y to 24K, a secondary roller 25, and a belt cleaner 26. Yet further included are a cleaning backup roller 27 and a remaining-toner collector 28.

The intermediate transfer belt 21 is stretched by a driving roller 22 arranged within a loop thereof, a driven roller 23, a cleaning backup roller 27, and four primary transfer rollers 24Y to 24K. The intermediate transfer belt 21 endlessly travels counter clockwise in the drawing as a driver, not shown, and drives and rotates the driving roller 22 counter clockwise.

The four primary transfer rollers 24Y to 24K collectively sandwich the endlessly traveling intermediate transfer belt 21 with the photo-conductive members 10Y top 10K. Thus, the Y to K use primary transfer nips are formed in places where the surface of the intermediate transfer belt 21 and the photo-conductive members 10Y to 10K contact each other.

Further, the primary transfer rollers 24Y to 24K receive primary transfer biases from a transfer bias power supply, not shown, respectively, so that transfer electric fields are created between the photo-conductive members 10Y to 10K and the primary transfer rollers 24Y to 24K, respectively.

Instead of the primary transfer rollers 24Y to 24K, transfer chargers or brushes can be employed.

When the K-toner on the surface of the photo-conductive member 10K enters the primary transfer nip for K use as the photo-conductive member 10K rotates, it is transferred onto the transfer belt 21 from the photo-conductive member 10K by affection of the transfer electric field and a nip pressure.

Further, the intermediate transfer belt 21 carrying the K toner image after the primary transfer process passes through the primary transfer nips for C to Y uses as it endlessly rotates. At that moment, Y to C toner images on the respective photo-conductive members 10Y to 10C are superimposed and transferred one after another onto the K toner image. As a result of such a superimposing primary transfer process, four color toner image is formed.

A secondary transfer roller 25 is arranged on an outside of the loop of the intermediate transfer belt 21 and sandwiches the intermediate transfer belt 21 with the driven roller 22 provided inside the loop. With such sandwiching, a secondary transfer nip is created at a place where the surface of the intermediate transfer belt 21 and the secondary transfer roller 25 contact each other.

Further, the secondary transfer roller 25 receives a second transfer bias from a transfer bias power supply, not shown, so that secondary transfer electric field is created between the second transfer roller 25 and the driving roller 22.

The sheet feeding cassette 5 is arranged vertically below a transfer unit 4 and accommodates plural recording sheets P stacked in a bundle state. The sheet feeding cassette 5 is slidably detachable and attachable from and to a casing of the printer 1.

A sheet feeding roller 5*a* contacts the topmost recording sheet P of the sheet bundle in the sheet feeding cassette 5, and launches thereof at a prescribed time by rotating counter clockwise in the drawing toward a sheet feeding path 30.

A pair of registration rollers 31 is arranged almost at a downstream end of the sheet feeding path 30 and stop rotation immediately after pinching the recording sheet P therebetween. The pair of registration rollers 31 resumes its rotational at a prescribed time and launch the recording sheet P pinched therebetween to enable the recording sheet P to synchronize with the four color toner image on the intermediate transfer belt 21 in the above-mentioned secondary transfer nip.

The four color toner image on the intermediate transfer belt 21 tightly contacting the recording sheet P in the secondary transfer nip is subjected to the secondary transfer electric field and the nip pressure and is transferred onto the recording sheet P at once, thereby a full color toner image is formed thereon. Such a recording sheet P with the full color image on its surface then separates from both the intermediate transfer belt 21 and the secondary transfer roller 25 due to their curvatures, and is conveyed to a fixing device 6 through a post transfer conveyance path 32.

There remains post transfer toner on the intermediate transfer belt 21 passing through the secondary transfer nip, which is not transferred onto the recording sheet P. Such remaining toner is removed from the surface of the belt by the belt cleaner 26 contacting thereof.

A cleaning back up roller 27 is arranged inside the loop of the intermediate transfer belt 21 to back up a cleaning operation executed by the belt cleaner 26 from inside the loop.

Further, a remaining toner collector 28 collects the remaining toner removed by the belt cleaner 26 from the surface of the intermediate transfer belt 21.

The fixing device 6 includes a fixing roller 6*a* having a heat source, not shown, such as a halogen lamp, etc., and a pressing roller 6*b* that rotates and contacts the fixing roller 6*a* under a prescribed pressure, so that a fixing nip is created therebetween.

The recording sheet P conveyed into the fixing device 6 is pinched in the fixing nip with its unfixed-toner image-carrying surface tightly contacting the fixing roller 6*a*. Then, due to the influence of the heat and the pressure, toner in the toner image is softened, thereby the full-color image is fixed.

Further, a pair of sheet ejection rollers 34 is arranged above the fixing device 6 and ejects the recording sheet P, which is ejected from the fixing device 6 and is conveyed through all of the post fixing conveyance path 33 and a sheet ejection path 35, onto a stack section of an upper cover 40 as mentioned later in detail. Specifically, when a simplex printer mode is inputted through an operation section having ten pad keys or the like, not shown, or instructed by a cont sig transmitted from a pc or the like, not shown, the recording sheet P pinched by the pair of sheet ejection rollers 34 is ejected as is.

By contrast, when a duplex printer mode is designated and a trailing end of the recording sheet P conveyed in the sheet ejection path 35 with its leading end being pinched by the pair of sheet ejection rollers 34 passes through a post fixing conveyance path 33, a switching pick 36 swings to change a conveyance path to which the recording sheet P is to be conveyed. At that moment, as the pair of sheet ejection rollers 34 reversely rotate, the recording sheet P is conveyed toward a reverse conveyance path 37. After that, the recording sheet P being reversed by the reverse conveyance path 37 is further conveyed through the sheet feeding path 30 again, and receives a full color toner image on its backside surface as in the simplex mode. Then, the recording sheet P is fixed and ejected from the machine.

Thus, a right side end of the apparatus body 1*a* having the above-mentioned reverse conveyance path 37 constitutes the reverse unit 38 that is held by a reverse unit cover 41. Specifically, the reverse unit 38 is openable with regard to the apparatus body 1*a* being held on the reverse unit cover 41.

Figure 3:
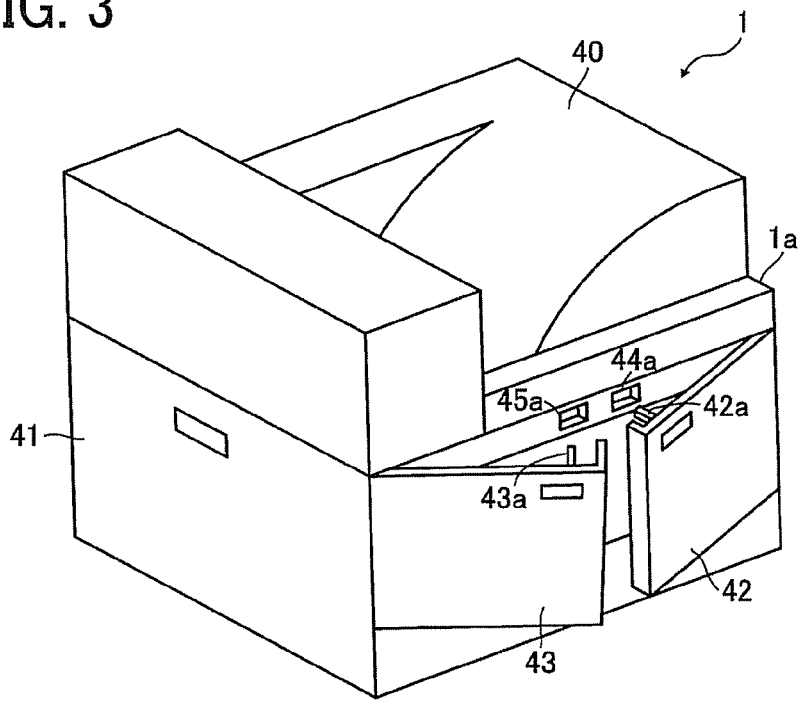
FIG. 3 schematically illustrates exemplary covers included in the printer equipped with the interlock system according to the first embodiment of the present invention.

Now, an exemplary cover provided in the printer 1 of this embodiment is described with reference to FIG. 3.

As shown, the printer 1 includes an upper cover 40, a reversing unit cover 41, and plural external covers 42 and 43 each openable with regard to the apparatus body 1*a*. The plural external covers 42 and 43 constitute first and second covers, respectively, in the present invention.

The upper cover 40 can be open at an upper portion of the apparatus body 1*a* when swung counter clockwise as shown by an arrow in FIG. 1.

Further, the optical writing unit 3 can be held by the upper cover 40 and is swung together therewith.

Any way, when the upper cover 40 is opened with regard to the apparatus body 1*a*, a wide upper opening exposed outside is formed on the printer 1. As a result, the four process units 2Y to 2K can readily be detached and attached to the apparatus body 1*a* through the upper opening.

The reversing unit cover 41 is arranged on a side surface of the apparatus body 1*a*, and is opened when swung clockwise as shown by an arrow in FIG. 1.

The external covers 42 and 43 are arranged on a prescribed side surface, i.e., the same plane, of the apparatus body 1*a*, and can open in a double door swing state when being swung at the same time toward a right-hand front side of the apparatus body 1*a* in the drawing.

At upper ends of rear surfaces of the external covers 42 and 43, there are provided external cover use strikers 42*a* and 43*a* protruding to the apparatus body 1*a*, respectively, and serve as pressing sections in the present invention.

The external covers 42 and 43 can be arranged on the other side surface than the right-hand front side of the apparatus body 1*a*.

Further, the apparatus body 1*a* includes plural striker-use holes 44*a* and 45*a* to permit the external cover use strikers 42*a* and 43*a* to penetrate and enter the apparatus body 1*a* when the external covers 42 and 43 are closed.

These striker use holes 44*a* and 45*a* are formed at positions corresponding to those of the external cover use strikers 42*a* and 43*a*, respectively, and serve as through-holes in the present invention.

Now, an exemplary interlock system 50 employed in the printer 1 including the cover is described with reference to FIGS. 4 to 9.

Figure 4:
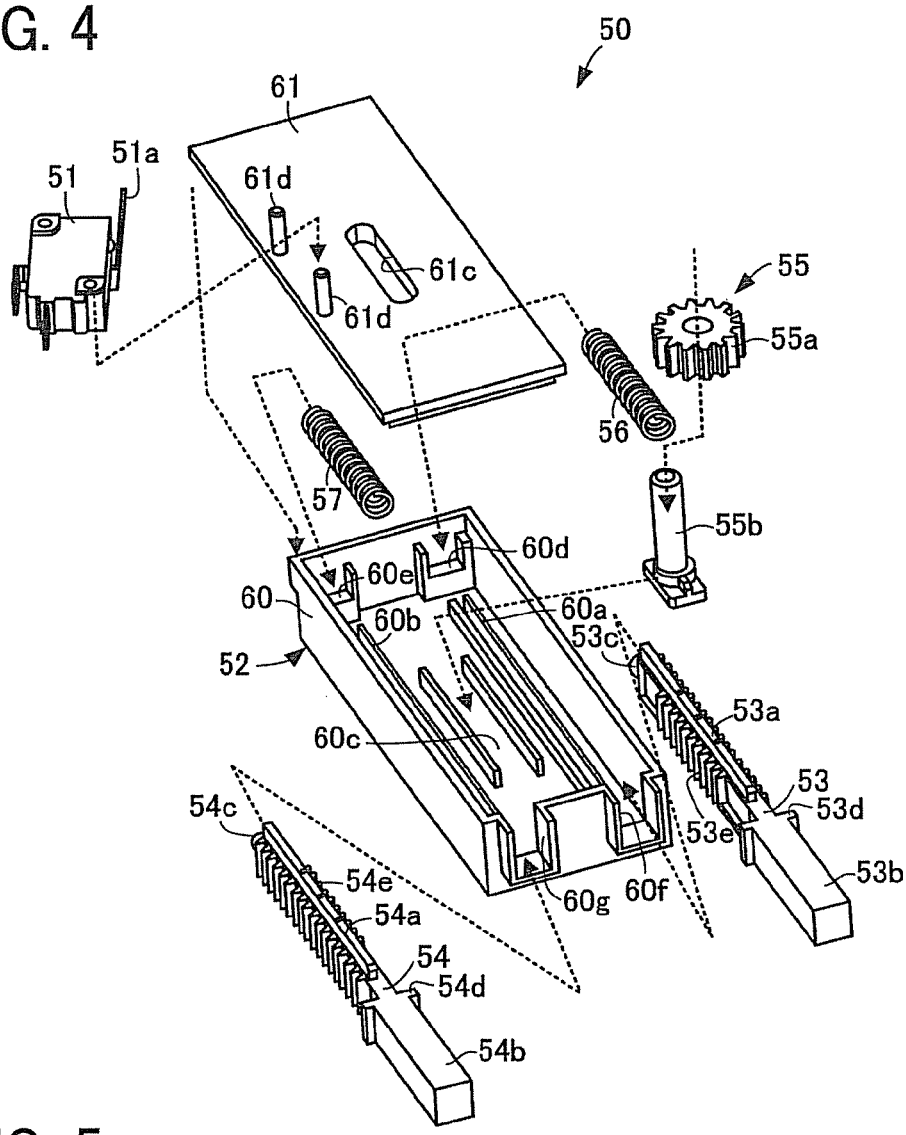
FIG. 4 is an exploded view schematically illustrating the exemplary interlock system of the first embodiment of the present invention.

As shown in FIG. 4, the interlock system 50 includes an interlock switch 51, a housing 52, and first and second racks 53 and 54. Also included are a pinion 55 and first and second bias members 56 and 57.

Figure 5:
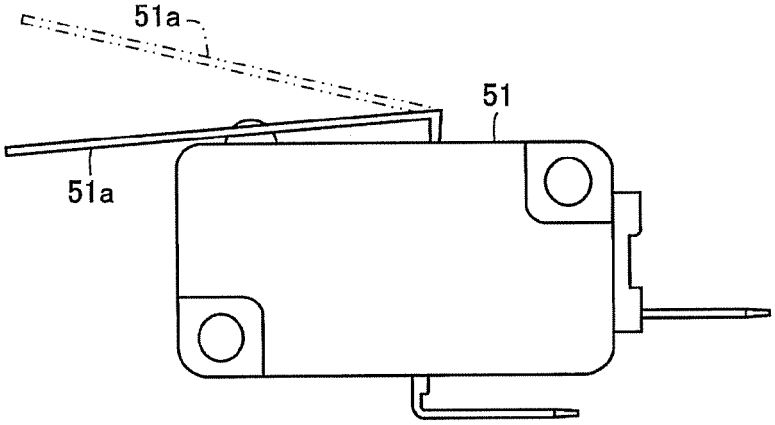
FIG. 5 schematically illustrates an exemplary interlock switch according to the first embodiment of the present invention.
Figure 6:
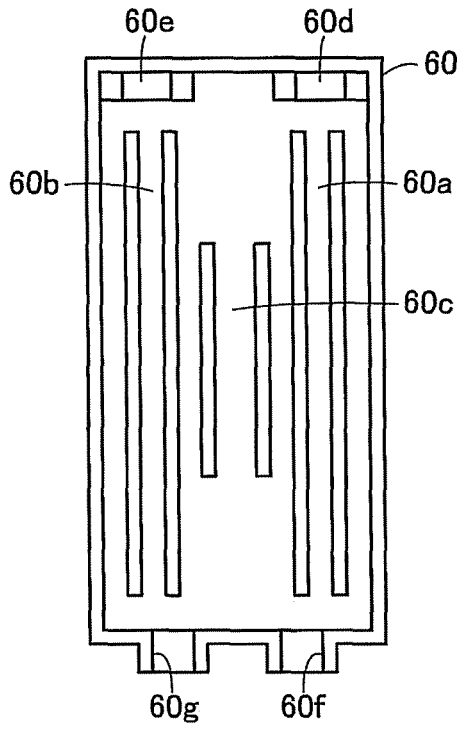
FIGS. 6A and 6B collectively illustrate exemplary lower and upper housings, respectively, according to the first embodiment of the present invention when viewed from above and beneath.
Figure 6:
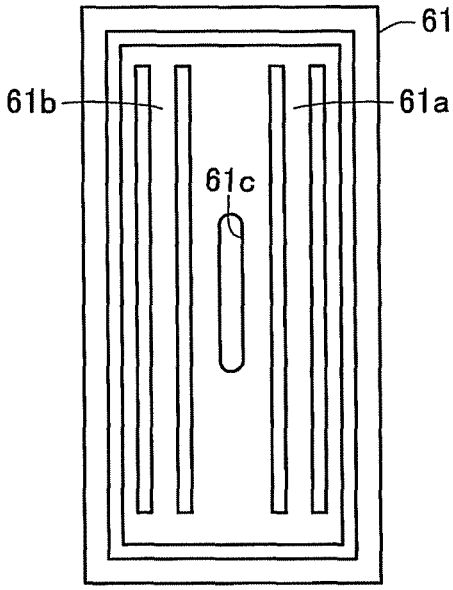

As shown in FIG. 5, the interlock switch 51 is constituted by a micro switch and is secured to an upper housing 61 included in the housing 52. The interlock switch 51 includes a swingable lever 51*a* between turn on and off positions when pressed and released by the pinion 55 in accordance with opening and closing of the first and second external covers 42 and 43. Consequently, the interlock switch 51 is turned on and off in response to swinging of the swingable lever 51*a*. In other words, the interlock switch 51 is turned on when the swingable lever 51*a* is pressed by the pinion 55 to enable the printer 1 to operate.

The swingable lever 51*a* is constituted by a cantilever having flexibility and mechanical strength not damaged by flexion deformity. A reactive force, i.e., a returning force, of the swingable lever 51*a* is equivalent to a prescribed level.

Further, the interlock switch 51 is turned off when pressure applied by the pinion 55 to the swingable lever 51*a* is released. As a result, connection between a power supply, not shown, and an electric instrument arranged in the apparatus body 1*a* is cut off on an electric circuit, so that the printer 1 stops an operation.

The housing 52 is constituted by a box like lower housing 60 having an upper opening, and the upper housing 61 that closes the upper opening of the lower housing 60, and is attached to the apparatus body 1*a* via a bracket, not shown. Further, the first and second racks 53 and 54, the pinion 55, and the first and second bias members 56 and 57 are installed in the housing 52.

As shown in FIGS. 4 and 6A, there are provided pair of rail sliders 60*a* and 60*b* longitudinally extending in parallel to each other on a bottom surface of the lower housing 60. These rail sliders 60*a* and 60*b* protrude from the bottom surface of the lower housing 60 facing each other to serve as reception grooves, which slidably support the rail sliders 53*a* and 53*b* of the first and second racks 53 and 54 mentioned later in detail in a longitudinal direction, respectively.

Further, there is provided a pinion slider 60*c* on the bottom of the lower housing 60 extending in a longitudinal direction between the rail sliders 60*a* and 60*b*. The pinion slider 60*c* is shorter than the pinion sliders 60*a* and 50*b* in the longitudinal direction, and is arranged in parallel thereto. The pinion sliders 60*c* also protrude from the bottom surface of the lower housing 60 facing each other to collectively serve as a reception groove, which slidably support the pinion supporters 55*b* of the pinion 55.

The above-mentioned rail sliders 60*a* and 60*b* and the pinion slider 60*c* can be constituted by reception grooves directly formed on the bottom surface of the lower housing 60.

Further, a pair of housing side supporters 60*d* and 60*e* are provided on one of inner side surfaces of the lower housing 60 in the longitudinal direction to supporting one ends of the first and second bias members 56 and 57, respectively.

Further, there are provided a pair of rack use openings 60*f* and 60*g* open to an outside on the other side of the lower housing 60 in the longitudinal direction.

As shown in FIG. 6B, there are provided a pair of rail sliders 61*a* and 61*b* on the lower surface of the upper housing 61 in correspondence with the rail sliders 60*a* and 60*b* arranged on the lower housing 60.

Further, there is provided an oblong hole 61*c* extending in a longitudinal direction on the upper housing 61 in parallel to the pair of rail sliders 60*a* and 60*b*.

Further, there are provided a pair of boss sections 61*d* protruding upward from the upper surface of the upper housing 61, to which the interlock switch 51 is secured.

Figure 7:
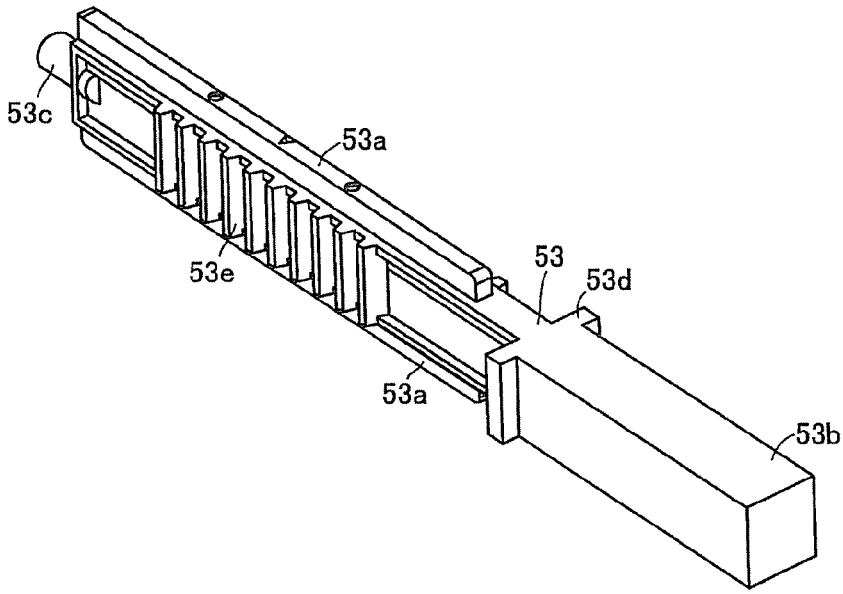
FIG. 7 schematically illustrates an exemplary rack according to the first embodiment of the present invention.

As shown in FIG. 7, the first rack 53 is constituted by a lengthy moving member, on upper and lower surfaces of which rail sections 53*a* are arranged, respectively, extending in the longitudinal direction. The rail section 53*a* is slidably supported by the rail sliders 60*a* and 61*a* when the first rack 53 is installed in the housing 60.

Figure 8:
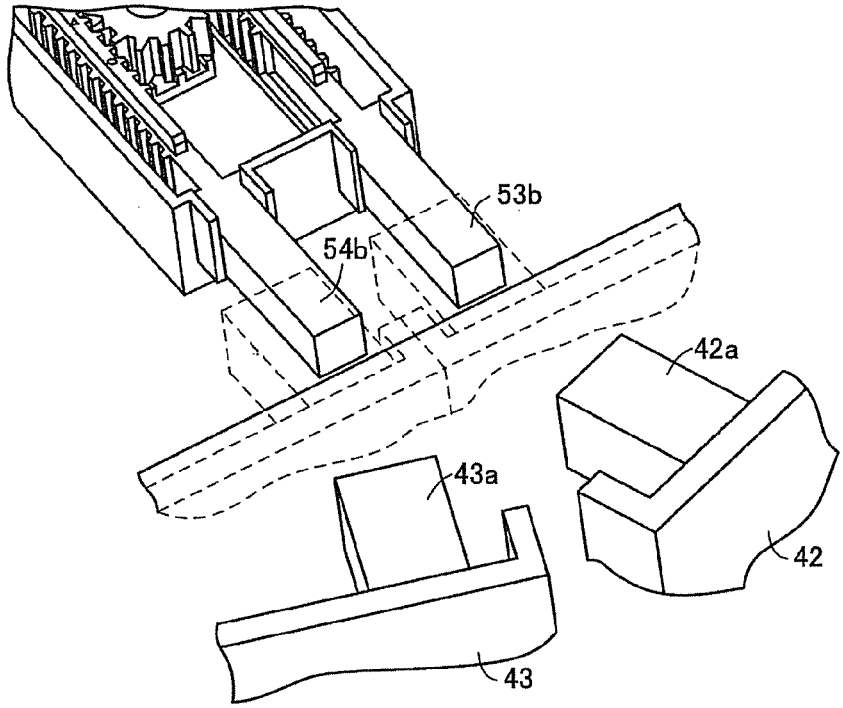
FIG. 8 partially illustrates the printer of the first embodiment of the present invention and an exemplary positional relation between the interlock system and external covers.

Further, as shown in FIGS. 7 and 8, a lever 53*b* is provided at one end of the first rack 53 in the longitudinal direction to be pressed by the external cover use striker 42*a* in conjunction with a closing of the first external cover 42.

Figure 10:
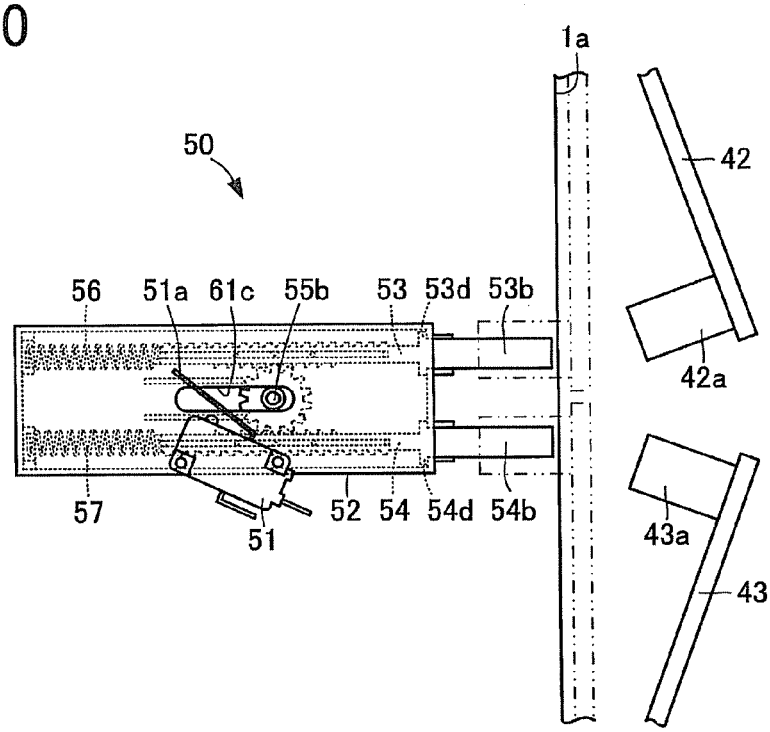
FIG. 10 illustrates an exemplary operation of the interlock system according to the first embodiment of the present invention when the external covers are open.
Figure 12:
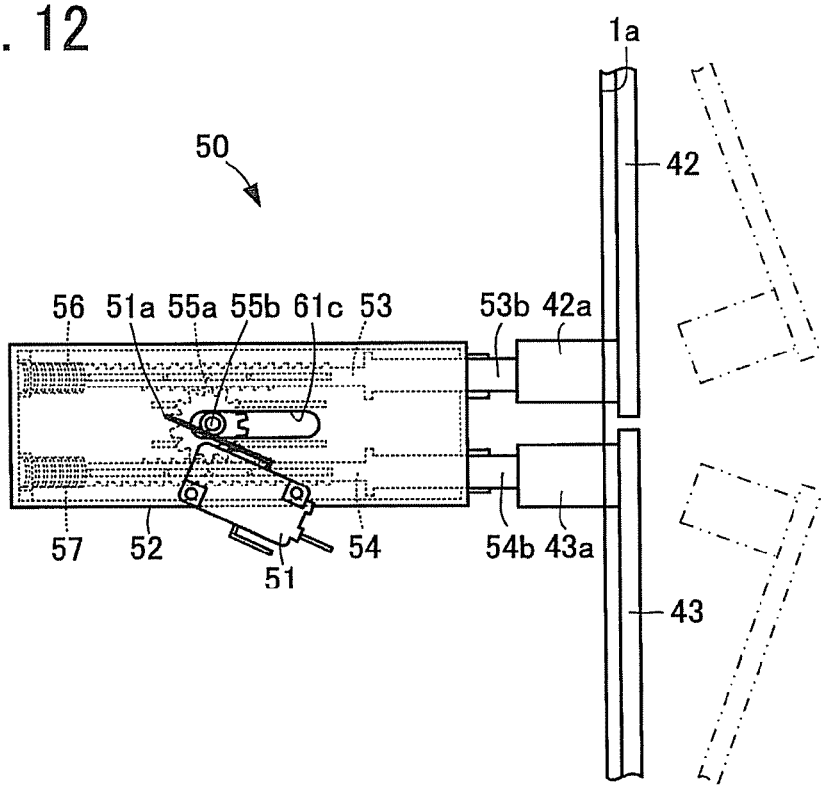
FIG. 12 illustrates an exemplary operation of the interlock system employed according to the first embodiment of the present invention when the external covers are closed.

Thus, the first rack 53 is enabled to move in the longitudinal direction from opening to closing positions as shown in FIGS. 10 and 12, respectively.

Further, a rack side supporter 53*c* is provided at the other end of the first rack 53 in the longitudinal direction to support the other end of the first bias member 56.

Figure 9:
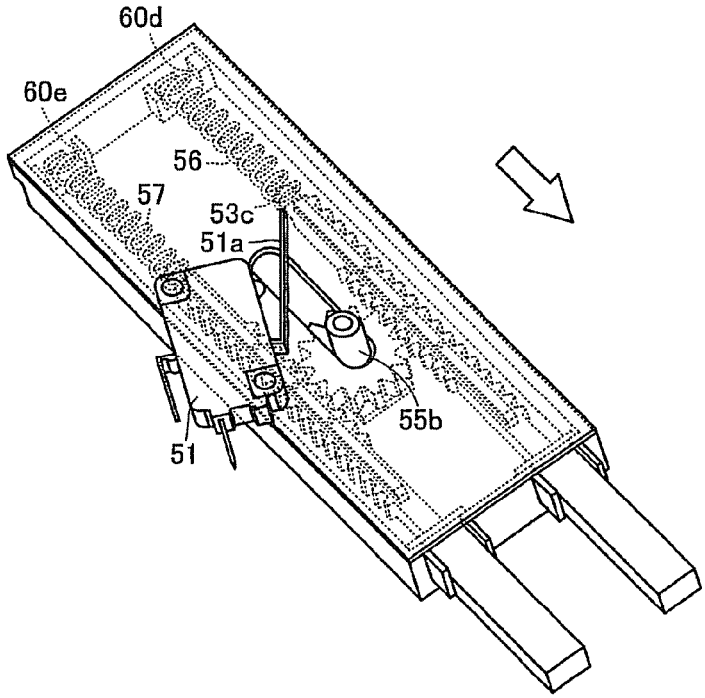
FIG. 9 schematically illustrates an external appearance of the interlock system according to the first embodiment of the present invention.

Thus, the first rack 53 is biased in a direction as shown by an arrow as shown in FIG. 9 by the first bias member 56 that engages both the lower housing 60 and the first rack 53 via the housing side supporter 60*d* and the rack side supporter 53*c*.

Consequently, when the pressure against the lever 53*b* is released in conjunction with the opening of the first external cover 42, the first rack 53 is enabled to move to the other one of sides in the longitudinal direction from the closing to opening positions as shown in FIGS. 12 and 10, respectively.

In this way, the first rack 53 is movable via the rail section 53*a* in the longitudinal direction in conjunction with opening and closing of the first external cover 42 between the opening and closing positions in the opening and closing states thereof.

Further, an engaging section 53*d* is provided at one end of the first rack 53, where the lever 53*b* is arranged, to engage with an inner wall surface of the lower housing 60 when the first rack 53 moves to the opening position (see FIG. 10).

Further, a meshing section 53*e* is provided extending in the longitudinal direction on one of side surfaces of the first rack 53 to face and mesh with the pinion 55.

As shown in FIG. 4, the second rack 54 is arranged in parallel to the first rack 53 to move in conjunction with the opening and closing of the second external cover 43 between the opening position thereof during an opening state and the closing position thereof during the closing state as shown in FIGS. 10 and 12, respectively.

The second rack 54 having substantially the same configuration is symmetrically arranged with the first rack 53 regarding the pinion 55 serving as a symmetrical center.

The pinion 55 including the pinion 55*a* and the pinion supporter 55*b* is arranged between the first and second racks 53 and 54.

The pinion 55*a* is relatively rotatably supported by a shaft of the pinion supporter 55*b* and meshes with the meshing sections 53*e* and 54*e* of the first and second racks 35 and 54, respectively.

The pinion supporter 55*b* freely rotatably supports the pinion 55*a* and is slidably supported by the pinion slider 60*c* of the lower housing 60 in the longitudinal direction.

Further, as shown in FIG. 9, the pinion supporter 55*b* is enabled to slide in the longitudinal direction within the oblong hole 61*c* of the upper housing 61 with an upper end of its shaft protruding from the oblong hole 61*c* when installed in the housing 52.

Thus, the pinion supporter 55*b* wish such a configuration slides in the longitudinal direction within the housing 52 as the pinion 55*a* rotates in conjunction with movement in the longitudinal direction of the first and second racks 53 and 54.

Further, the swingable lever 51*a* of the interlock switch 51 is arranged above the oblong hole 61*c* on the upper surface of the upper housing 61. The pinion supporter 55*b* is enabled to press the swingable lever 51*a* of the interlock switch 51 and release the pressure applied thereto in accordance with sliding thereof in the longitudinal direction.

As shown in FIGS. 4 and 9, the first bias member 56 may be constituted by a compression spring, engages the first housing side supporter 60*d* and the rack side supporter 53*c*, and biases the first rack 53 by a prescribed bias force $F_2$ in a direction as shown by an arrow in FIG. 9.

The second bias member 57 has substantially the same configuration as the first bias member 56, engages the housing side supporter 60*e* and the rack side supporter 53*c*, and biases the second rack 54 by the prescribed bias force $F_2$ in a direction as shown by an arrow in FIG. 9.

Such a prescribed bias force $F_2$ is greater than a reactive force of the above-mentioned swingable lever 51*a* that is equivalent to the returning force F1.

Now, an exemplary operation of the interlock system 50 according to one embodiment of the present invention is described with reference to FIG. 10. When both the external covers 42 and 43 are open with regard to the apparatus body 1*a*, the first and second racks 53 and 54 are biased by the first and second bias members 56 and 57 to the right in the drawing, so that the levers 53*b* and 54*b* are withdrawn from the housing 52 to the outside.

Then, the first and second racks 53 and 54 are held at the opening positions as shown in FIG. 10, when the engaging sections 53*d* and 54*d* engage with the inner wall surfaces of the lower housing 60 (see FIG. 4).

At that moment, the pinion supporter 55*b* is located at the rightmost side on the other side in the oblong hole 61*c* in the longitudinal direction and separates farthest from the swingable lever 51*a* of the interlock switch 51.

Figure 11:
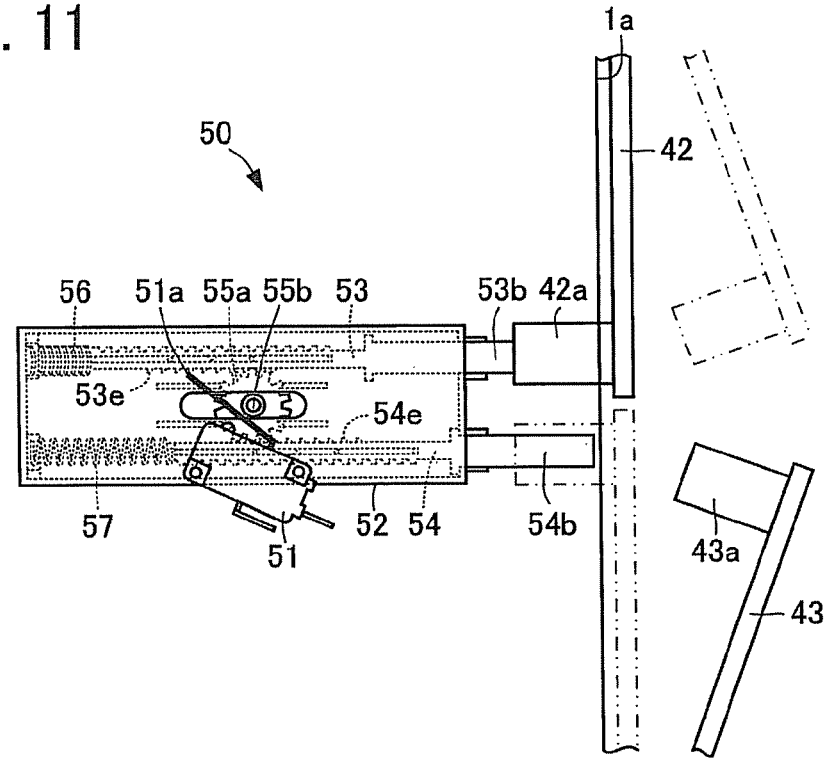
FIG. 11 illustrates an exemplary operation of the interlock system according to the first embodiment of the present invention when only one of the external covers is opened.

In such a situation, when the external cover 42 opens with regard to the apparatus body 1*a* as shown in FIG. 11, the external cover use striker 42*a* is inserted into an interior of the apparatus body 1*a* through the striker use opening 44*a* (see, FIG. 3) formed in the apparatus body 1*a*, and then presses the lever 53*b* of the first rack 53.

Consequently, the first rack 53 moves to one of sides in the longitudinal direction, i.e., a left side in the drawing, in the housing 52 against the bias force F2 of the first bias member 56, and is held at the closing position.

At this moment, since the meshing section 53*e* moves to one of sides in the longitudinal direction as the first rack moves thereto, the pinion 55*a* rotates counter clockwise in the drawing meshing with the meshing section 53*e*. Since it also meshes with the meshing section 54*e* of the second rack 54 held at the opening position, the pinion 55*a* moves together with the pinion supporter 55*b* to one of sides in the longitudinal direction. Specifically, the pinion supporter 55*b* slides to one of sides of the longitudinal direction within the oblong hole 61*d* and stops at a middle point thereof. An exemplary amount of movement of the pinion supporter 55*b* is described later in detail.

In such a condition, the pinion supporter 55*b* almost contacts the swingable lever 51*a* of the interlock switch 51, but not yet presses thereof, so that the interlock switch 51 is turned off.

Subsequently, when the external cover 43 is closed with regard to the apparatus body 1*a* from the above-mentioned condition as shown in FIG. 12, the external cover use striker 43*a* is inserted into the apparatus body 1*a* through the striker use opening 45*a* (see, FIG. 3) formed in the apparatus body 1*a*, and presses the lever 54*b* of the second rack 54, as the first rack 54.

Consequently, the second rack 54 moves to one of sides in the longitudinal direction, i.e., a left side in the drawing, in the housing 52 against the bias force F2 of the second bias member 56.

At this moment, since the meshing section 54*e* moves to one of sides in the longitudinal direction as the second rack moves thereto, the pinion 55*a* meshing with the meshing section 54*e* rotates clockwise in the drawing. Since it also meshes with the meshing section 53*e* of the first rack 53 held at the closing position, the pinion 55*a* moves together with the pinion supporter 55*b* to one of sides of the longitudinal direction.

Specifically, the pinion supporter 55*b* slides to a position of the oblong hole 61*c* to press the swingable lever 51*a* of the interlock switch 51 as the pinion 55*a* rotates clockwise.

Consequently, the interlock switch 51 is turned on when the pinion supporter 55*b* presses the swingable lever 51*a*.

As mentioned heretofore, when the external covers 42 and 43 are closed, the interlock switch 51 is turned on, and any one of the external covers 42 and 43 then opens, e.g. the external cover 43 opens as shown in FIG. 11, the pressure applied to the lever 54*b* by the external cover use striker 43*a* is released. Subsequently, the second rack 54 moves to the other side of the longitudinal direction receiving the influence of the bias force F2 of the second bias member 57.

At that moment, the pinion 55*a* meshing with the meshing section 54*e* of the second rack 54 rotates counter clockwise in the drawing, and moves to the other side of the longitudinal direction in the oblong hole 61*c*.

Consequently, the pressure applied to the swingable lever 51*a* by the pinion supporter 55*b* is released, and the interlock switch 51 is turned off.

Although a rotational direction of the pinion 55*a* is different, a similar operation is executed when the external cover 42 opens as executed when the above-mentioned external cover 43 opens.

As mentioned heretofore, when both the external covers 42 and 43 are closed, and then any one of them opens, the interlock switch 51 is turned off.

Figure 13:
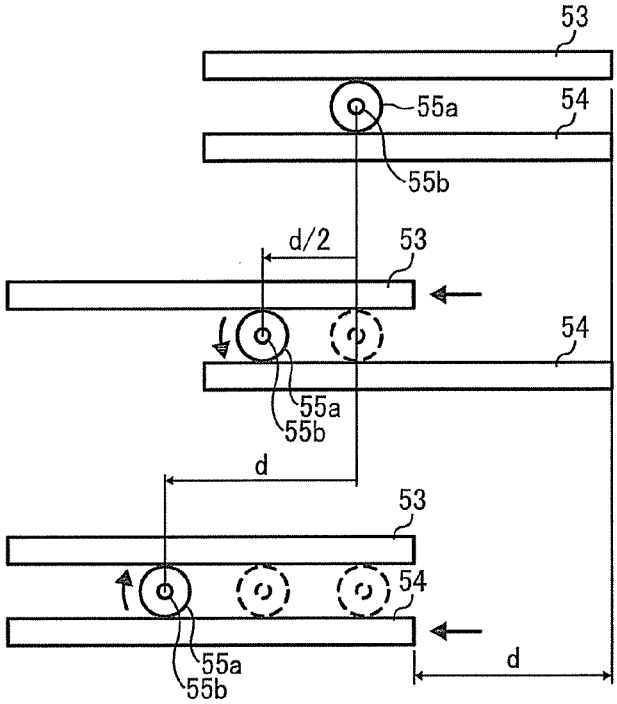
FIG. 13 illustrates an exemplary amount of movement of a pinion supporter according to the first embodiment of the present invention.

Now, an amount of movement of the pinion supporter 55*b* accompanying an opening and closing of the external covers 42 and 43 is described with reference to FIG. 13.

As shown, wherein only principal parts of the first and second racks 53 and 54, the pinion 55*a*, and the pinion supporter 55*b* are briefly described for the sake of simplicity of explanation.

As shown, exemplary positional transition of covers from opening to closing states is illustrated in FIGS. 10 to 12.

As understood therefrom, when the first rack 53 moves to the left by an amount of d in the drawing, the pinion supporter 55*b* moves by an amount of d/2, due to counter clockwise rotation of the pinion 55*a* that meshes with the second rack 54 in the halt condition.

Subsequently, when the second rack 54 moves to the left by an amount of d in the drawing, the pinion supporter 55*b* further moves by an amount of d/2, due to clockwise rotation of the pinion 55*a* that meshes with the first rack 53 in the halt condition. As a result, when both the first and second racks 53 and 54 move to the left by the amount of d, the pinion supporter 55*b* also moves to the left by the amount of d.

Both the covers 42 and 43 are possibly practically closed at the same time. In such a situation, since both the first and second racks 53 and 54 move to the left, the pinion 55*a* also moves to the left without rotating while being sandwiched therebetween. Since the pinion 55*a* does not rotate, the amount of movement of the pinion supporter 55*b* is equivalent to that of the first or second rack 53 or 54 (i.e., d).

In this way, regardless of whether the first and second racks 53 and 54 separately or simultaneously move, a total amount of the pinion supporter 55*b* is the same.

Hence, according to one embodiment of the present invention, each of members constituting the interlock system 50 does not need to set complex conditions or control strict part tolerance, and thus opening and closing of plural covers, such as external covers 42 and 43, etc., can be simply detected with a single interlock switch 51 thereby simplifying a detection construction while saving cost. Because, the interlock switch 51 is turned on and off by sliding the pinion 55 engaging with the meshing sections 53*e* and 54*e* of the first and second racks 53 and 54 which moves in conjunction with an opening and closing of the external covers 42 and 43.

According to this embodiment, the pinion supporter 55*b* can precisely be slid linearly in the longitudinal direction. Because, the pinion 55 includes the pinion 55*a* that meshes with the meshing sections 53*e* and 54*e* of the respective the first and second racks 53 and 54 and the pinion supporter 55*b* that freely rotatably supports the pinion 55*a*, while the lower housing 60 includes the pinion slider 60*c* that slidably supports the pinion supporter 55*b* in the longitudinal direction. Further, the pinion 55*a* can stably mesh with the meshing sections 53*e* and 54*e* preventing from skipping of a gear teeth.

Further, since the first and second bias members 56 and 57 that bias the respective first and second racks 53 and 54 toward their respective closing positions in this embodiment, the respective first and second racks 53 and 54 can be slid promptly when the external covers 42 and 43 are closed.

Further, since the respective first and second racks 53 and 54 include the engaging sections 53*d* and 54*d* that engage with the inner wall surfaces of the lower housing 60 at the opening positions in this embodiment, the respective first and second racks 53 and 54 can be stably held at the opening positions, even when both the external covers 42 ad 43 are open.

Further, since the interlock switch 51 is secured to the boss section 61*d* of the upper housing 61, the interlock system 50 can be made into a unit.

Further, since the respective first and second racks 53 and 54 include the levers 53*b* and 54*b* at one ends in the longitudinal direction, which are pressed by the external cover use strikers 42*a* and 43*a* in conjunction with the closing of the external covers 42 and 43, the respective first and second racks 53 and 54 can be slid in the longitudinal direction within the housing 52 in a simple structure that simply presses the levers 53*b* and 54*b*.

Further, according to this embodiment, the single interlock switch 51 can detect a full open condition of the external covers 42 and 43, and an opening condition of only one of them. Because, the interlock switch 51 is turned on by the swingable lever 51*a* when the swingable lever 51*a* is pressed by the pinion supporter 55*b* sliding to one of sides in the longitudinal direction when both the external covers 42 and 43 are closed. Further because, the interlock switch 51 is turned off by the swingable lever 51*a* when any one of the external covers 42 and 43 is opened, the pinion supporter 55*b* slides to the other side in the longitudinal direction, and the pressure applied thereto is released.

Further, since the interlock switch 51 is constituted by the micro switch, supplying and cutting off power from a power supply to the load can be controlled on the electric circuit useful as a safety system.

Depending upon arrangement of the interlock switch 51, the returning force F1 of the swingable lever 51*a* sometimes serves as a resistance to sliding operations of the first and second racks 53 and 54, so that they cannot slide in the housing 52.

However, according to this embodiment, since the bias force F2 of each of the first and second bias members 56 and 57 is greater than the returning force F1 of the swingable lever 51*a*, such an inconvenience can be reduced or suppressed.

Further, since the levers 53*b* and 54*b* do not protrude from the apparatus body 1*a* even when the external covers 42 and 43 are open, they are not erroneously pressed. Because, when the external covers 42 and 43 are closed, the external cover use strikers 42*a* and 43*a* are inserted into the apparatus body 1*a* through the striker use holes 44*a* and 45*a*, and press the levers 53*b* and 54*b* there, respectively.

As a result, the interlock system 50 is not operated by erroneously pressing the levers 53*b* and 54*b* even when the external covers 42 and 43 are open.

Now, another interlock system 70 according to a second embodiment of the present invention is described with reference to FIGS. 14 to 20.

Figure 14:
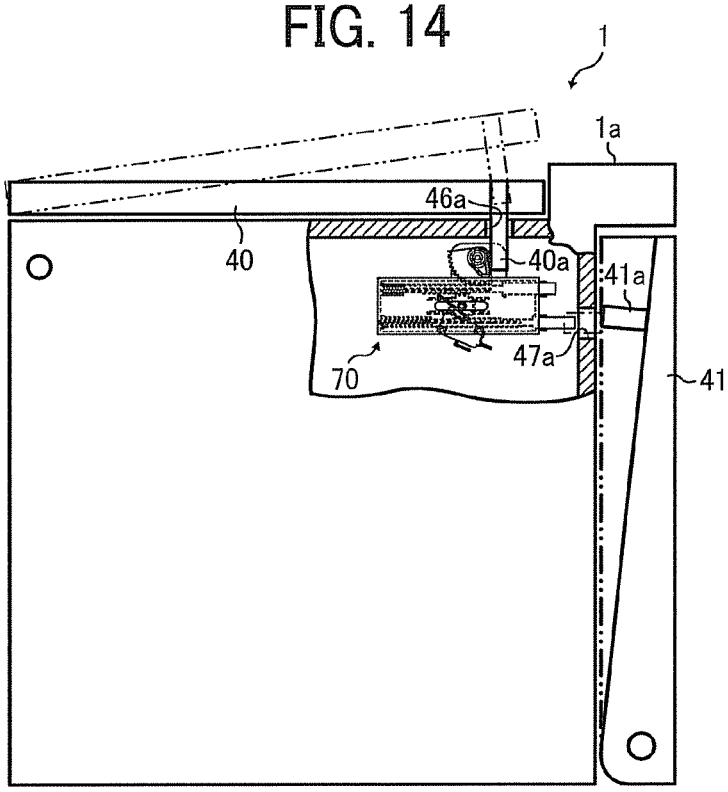
FIG. 14 schematically illustrates each of exemplary covers included in a printer equipped with an interlock system according to a second embodiment of the present invention.

Different from the interlock system 50 provided to the external covers 42 and 43 of a double swing door type on the same side surface of the apparatus body 1*a* as mentioned in the first embodiment, an interlock system 70 of this embodiment is openable and closable with regard to the apparatus body 1*a* on planes perpendicular to each other. Specifically, the interlock system 70 is provided to the upper cover 40 and a reversing unit cover 41, for example, as shown in FIG. 14. Specifically, although it is only described herein below, the interlock system 70 is not limited thereto, and can be provided to another openable and closable members as far as they are openable and closable on planes perpendicular to each other.

Anyway, the interlock system 70 has almost the same configuration and executes the same operation as the interlock system 50 of the first embodiment except for additionally including a rack actuation mechanism. Thus, only the difference is hereinafter described.

As shown in FIG. 14, at one ends on rear surfaces of the upper cover 40 and the reversing unit cover 41 different than other ends thereof where rotational fulcrums are provided, there are provided an upper cover use striker 40*a* and a unit cover use striker 41*a* protruding to the apparatus body 1*a*, respectively. These upper cover use striker 40*a* and the unit cover use striker 41*a* serve as pressing sections in the second embodiment of the present invention.

The apparatus body 1*a* includes plural striker use holes 46*a* and 47*a* to permit the upper cover use strikers 40*a* and the unit cover use striker 41*a* to penetrate into the apparatus body 1*a* when the upper cover 40 and the reversing unit cover 41 are closed. These striker use holes 46*a* and 47*a* are formed at positions corresponding to the upper cover use striker 40*a* and the unit cover use striker 41*a*, respectively, and serve as through-holes in the second embodiment of the present invention.

Figure 15:
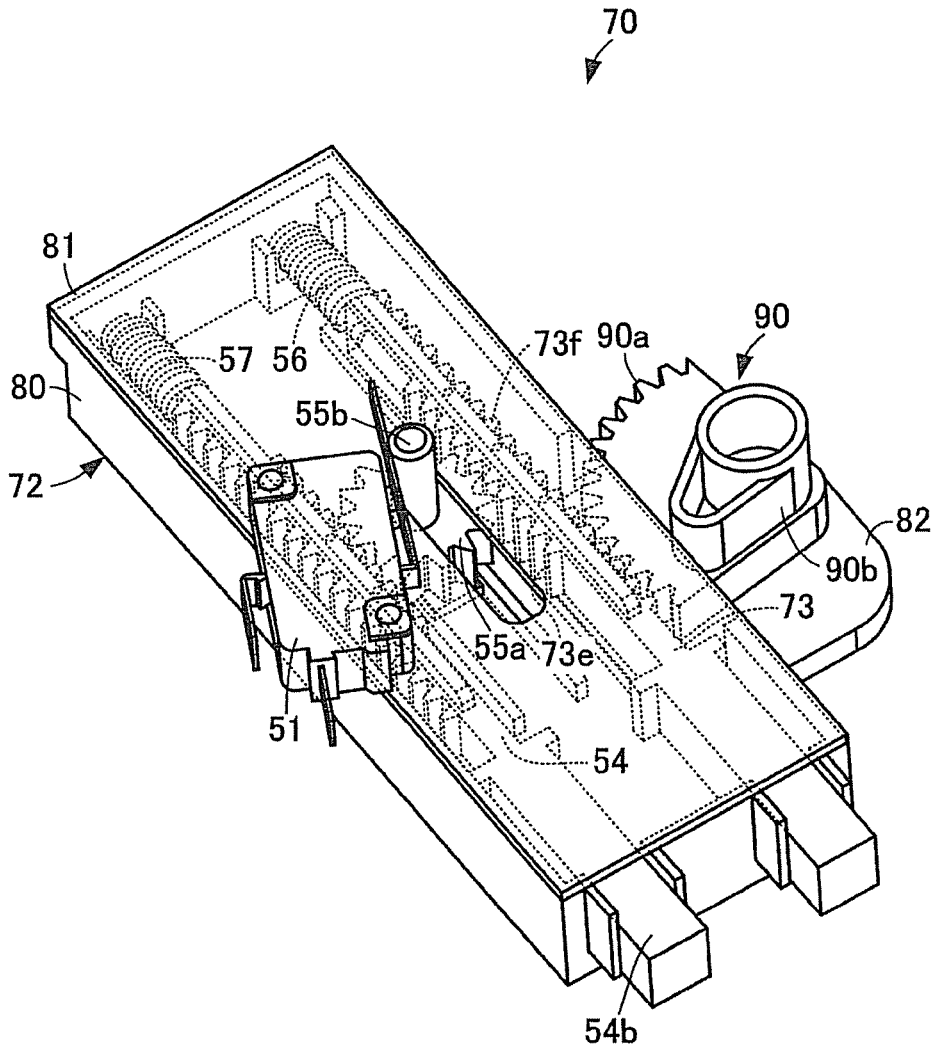
FIG. 15 is a perspective view entirely illustrating an exemplary interlock system according to the second embodiment of the present invention.

As shown in FIG. 15, the interlock system 70 includes an interlock switch 51, a housing 72, and first and second racks 73 and 54. Also included are a pinion 55 and first and second bias members 56 and 57, and a rack activation mechanism 90.

The interlock switch 51, the second rack 54, the pinion 55, and the first and second bias members 56 and 57 have the same configuration and operations as in the first embodiment, and thus explanation of those is omitted herein after.

The housing 72 is constituted by a box like lower housing 80 having an upper opening, and the upper housing 81 that closes the upper opening of the lower housing 80, and is attached to the apparatus body 1*a* via a bracket or the like, not shown.

The housing 72 has substantially the same configuration as the housing 52 of the first embodiment, but is different therefrom by additionally including a mechanism supporter 82 that supports the rack actuation mechanism 90 on the lower housing 80.

Figure 16:
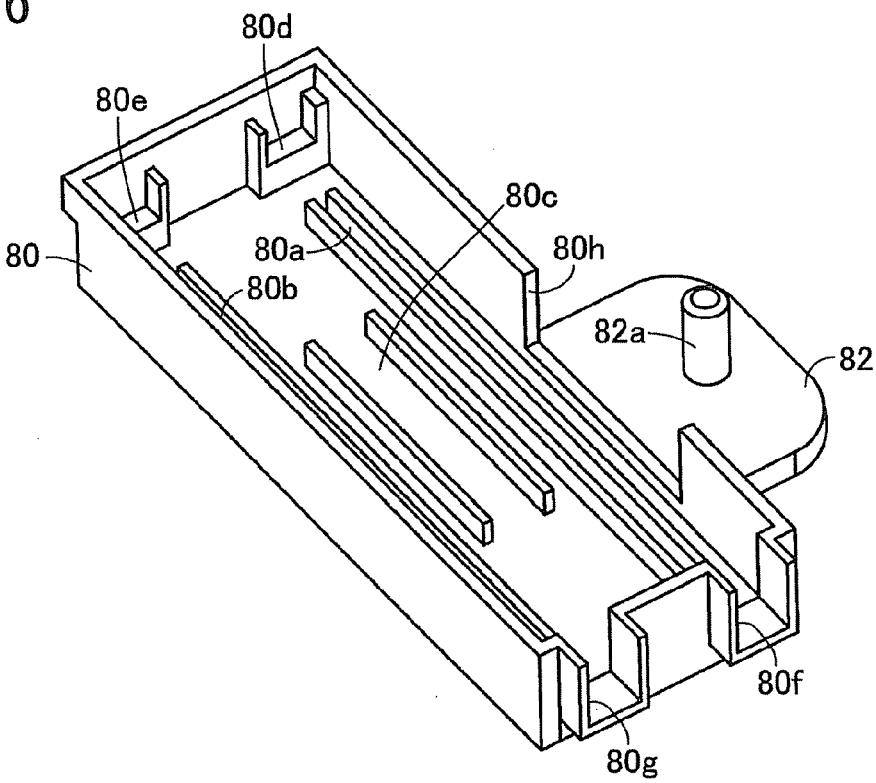
FIG. 16 is a perspective view illustrating an exemplary lower housing according to the second embodiment of the present invention.

As shown in FIG. 16, there are provided on a bottom surface of the lower housing 80 a pair of rail sliders 80*a* and 80*b* and a pinion slider 80*c* as the lower housing 60 of the first embodiment. Further, on inner side surfaces arranged in the lower housing 80 in the longitudinal direction, there are provided housing side supporters 80*d* and 80*e* and rack used opening sections 80*f* and 80*g*, respectively.

In one of side surfaces in a direction perpendicular to the longitudinal direction of the lower housing 80 (i.e., a side of a rail slider 80*a*), there is formed a cutaway section 80*h*.

The lower housing 80 also includes a mechanism supporter 82 that protrudes from the housing at the cutaway section 80*h*.

The mechanism supporter 82 includes a shaft section 82*a* and freely rotatably supports the rack actuation mechanism 90 via the shaft section 82*a* as shown in FIG. 15.

The upper housing 81 has the same configuration as the upper housing 61 of the first embodiment. Thus, explanation of the configuration of the upper housing 81 is omitted.

The first rack 73 includes a rack gear 73*f* extending in a longitudinal direction on a side surface opposite to a side surface, where a meshing section 73*e* is formed to mesh with the pinion 55*a*, i.e., on a side surface that faces the cutaway section 80*h* of the lower housing 80.

The rack gear 73*f* meshes with an actuation gear 90*a* provided in the rack actuation mechanism 90 mentioned later in detail at a position corresponding to the cutaway section 80*h*. The above-mentioned rack gear 73*f* constitutes a rack actuation use meshing section in the present invention.

The rack actuation mechanism 90 includes an actuation gear 90*a* and a cam 90*b*, and is enabled to move the first rack 73 in a longitudinal direction in conjunction with opening and closing of the upper cover 40 (see FIG. 14).

Figure 17:
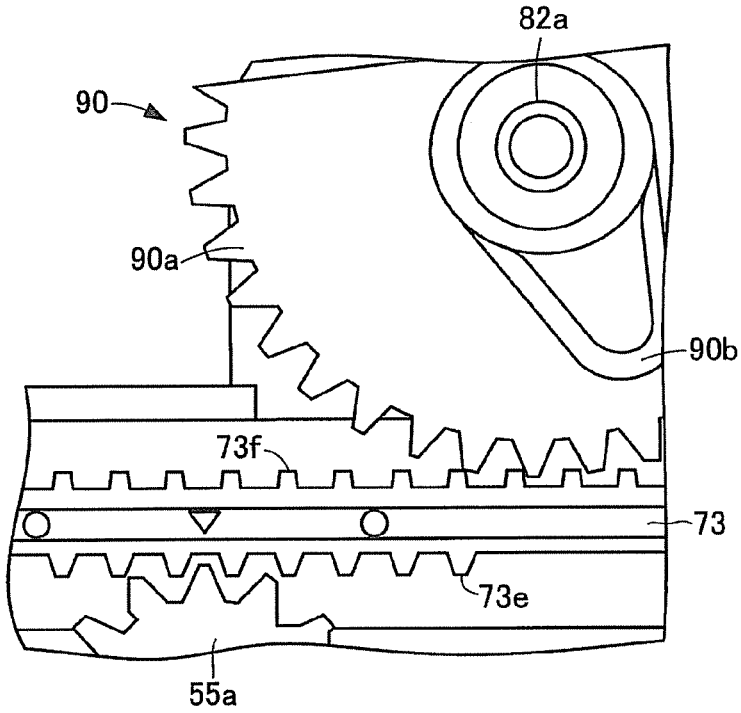
FIG. 17 partially illustrates the interlock system employed in the second embodiment of the present invention.

As shown in FIG. 17, the actuation gear 90*a* has a fan-like shape and is freely rotatably supported by a shaft section 82*a* of the mechanism supporter 821 as a fulcrum. The actuation gear 90*a* serves as a gear in the present invention.

Figure 18:
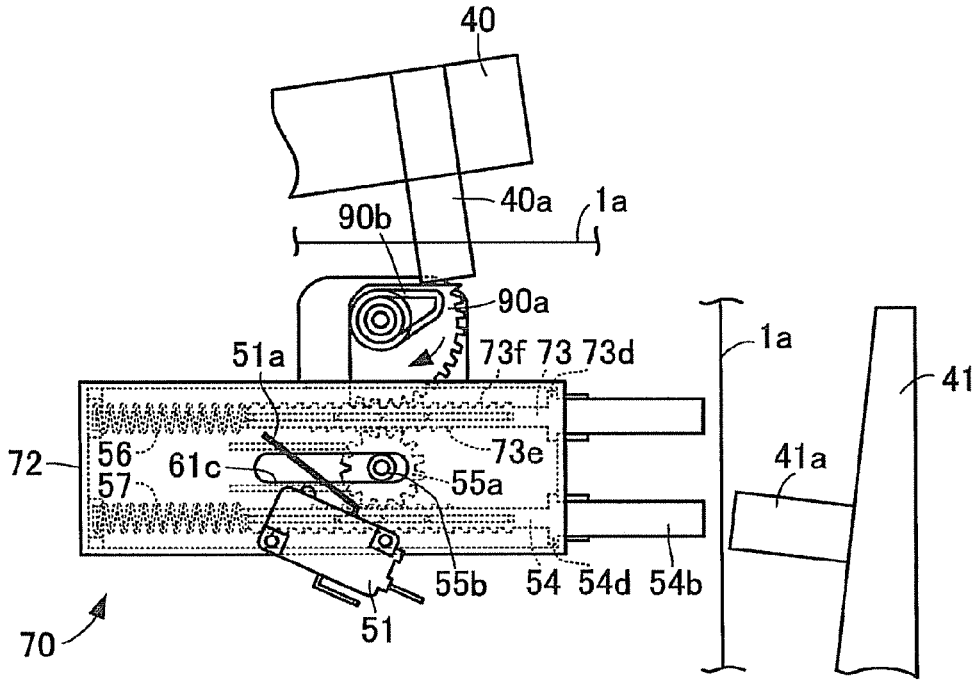
FIG. 18 illustrates an exemplary operation of the interlock system according to the second embodiment of the present invention when upper and reverse unit covers are open.
Figure 19:
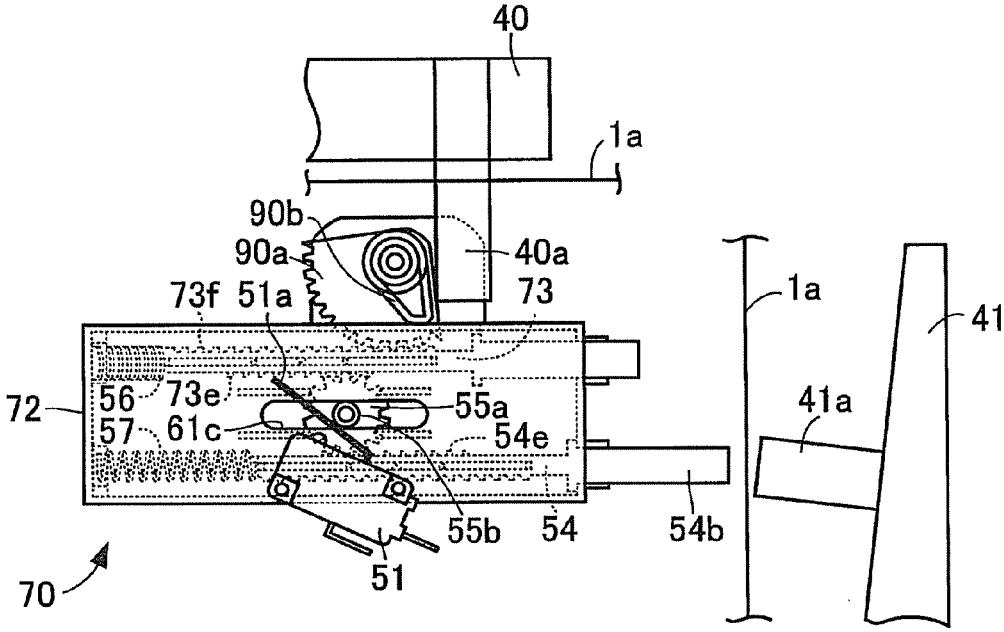
FIG. 19 illustrates an exemplary operation of the interlock system according to the second embodiment of the present invention when the upper cover is closed.
Figure 20:
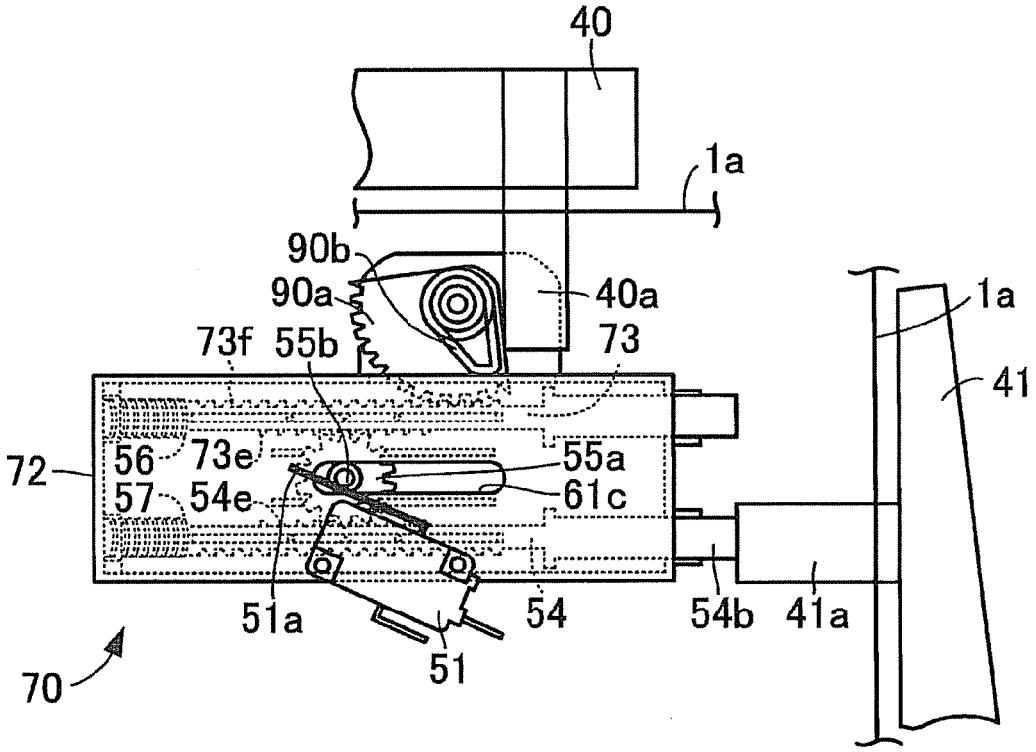
FIG. 20 illustrates an exemplary operation of the interlock system according to the second embodiment of the present invention when upper and reverse unit covers are closed.
Figure 21:
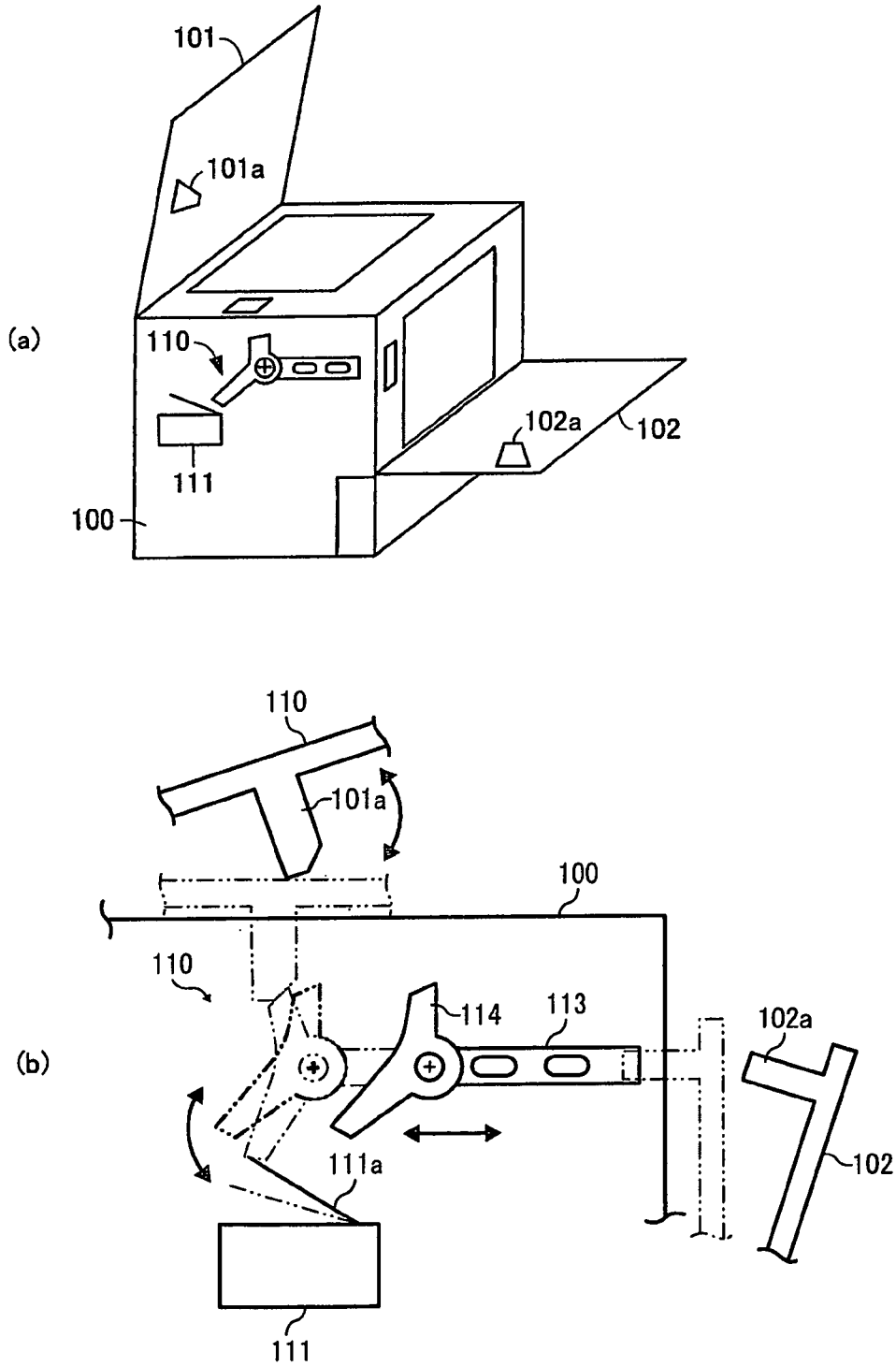
FIGS. 21A and 21B illustrate an image forming apparatus including a conventional interlock system and a schematic configuration of the interlock system, respectively.
Figure 22:
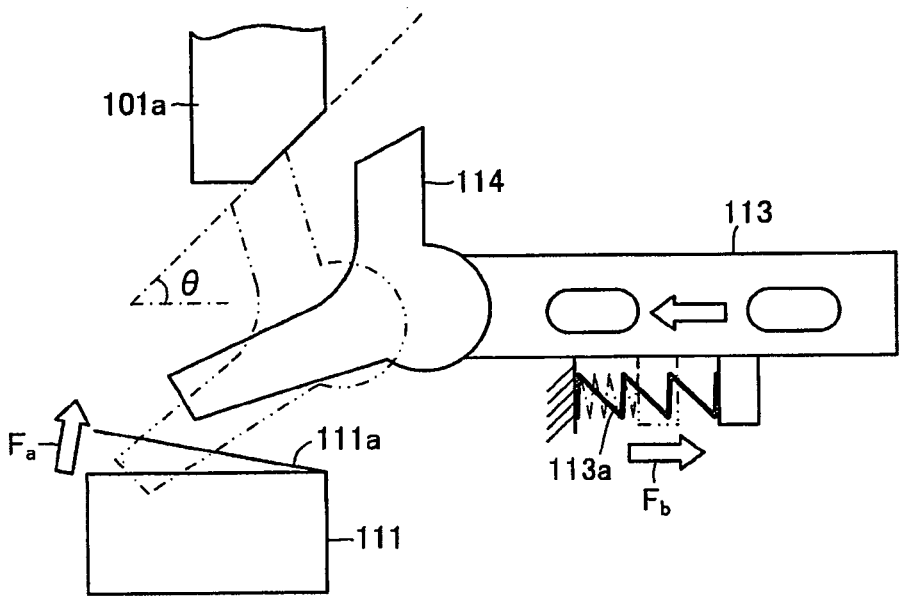
FIG. 22 illustrates the expanded conventional interlock system.

As shown in FIGS. 18 to 20, the cam 90*b* is provided on the actuation gear 90*a*, and is pressed by the upper cover use striker 40*a* in conjunction with closing of the upper lever 40 (see FIG. 14). Thus, the cam 90*b* moves together with the actuation gear 90*a* in a direction shown by an arrow in FIG. 18, i.e., clockwise, when being pressed by the upper cover use striker 40*a*.

The cam 90*b* is integrated with the actuation gear 90*a* by molding, securing with a fastener, adhesive, or depositing and the like.

Now, an exemplary operation of the interlock system 70 is described with reference to FIG. 18. As shown, when both the upper and reversing unit covers 40 and 41 are open with regard to the apparatus body 1*a*, both the first and second racks 73 and 54 are biased to the right in the drawing by the first and second bias members 56 and 57, respectively.

The first and second racks 73 and 54 are then held at opening positions when the engaging sections 73*d* and 54*d* contact the inner wall surfaces of the lower housing 80 (see FIG. 15), respectively, as shown in FIG. 18.

At this moment, the pinion supporter 55*b* is positioned on the rightmost other one of sides in the longitudinal direction within the oblong hole 61*c* in the drawing. Specifically, the pinion supporter 55*b* is located farthest from the swingable lever 51*a* of the interlock switch 51.

In such a situation, when the upper cover 40 is closed with regard to the apparatus body 1*a* as shown in FIG. 19, the upper cover striker 40*a* is inserted into the apparatus body 1*a* through the striker use hole 46*a* formed on the apparatus body 1*a* (see FIG. 14), and presses a cam 90*b* of a rack actuation mechanism 90.

As the upper cover striker 40*a* presses the cam 90*b*, the cam 90*b* and the actuation gear 90*a* rotate clockwise as shown by an arrow in FIG. 18.

Further, because the actuation gear 90*a* meshes with the rack gear 73*f*, the first rack 73 moves to the left in the drawing within the housing 72, i.e., one of sides in a longitudinal direction, against the bias force F2 of the first bias member 56 and is held at the closing position.

Further, since the meshing section 73*e* also moves toward one of sides in the longitudinal direction as the first rack 73 moves thereto, the pinion 55*a* rotates counter clockwise meshing with the meshing section 73*e*. Since the pinion 55*a* also meshes with the meshing section 54*e* of the second rack 54 held at the opening position, the pinion 55*a* moves to one of sides in the longitudinal direction together with the pinion supporter 55*b*. Specifically, as the pinion 55*a* rotates counter clockwise, the pinion supporter 55*b* slides to one of sides in the longitudinal direction within the oblong hole 61*c* and stops at a middle point thereof. An amount of movement of the pinion supporter 55*b* is the same as in the first embodiment.

In such a condition, the pinion supporter 55*b* is positioned in the vicinity or contacts the swingable lever 51*a* of the interlock switch 51, but does not press thereof, and thus the interlock switch 5 is yet turned off.

Subsequently, from this condition, when the reversing unit cover 41 is closed with regard to the apparatus body 1*a* as shown in FIG. 20, the unit cover use striker 41*a* is inserted into the apparatus body 1*a* through the striker use opening 47*a* (see FIG. 14) formed on the apparatus body 1*a*, and then presses the lever 54*b* of the second rack 54 as similar to the upper cover 40.

Consequently, the second rack 54 moves to the left in the drawing, i.e., toward one of sides in the longitudinal direction, within the housing 72 against the bias force F2 of the second bias member 57.

At this moment, since the meshing section 54*e* also moves toward one of sides in the longitudinal direction as the second rack 54 moves thereto, the pinion 55*a* rotates clockwise in the drawing meshing with the meshing section 54*e*. Since the pinion 55*a* also meshes with the meshing section 73*e* of the first rack 73 held at the closing position, the pinion 55*a* moves to one of sides in the longitudinal direction together with the pinion supporter 55*b*.

Specifically, as the pinion 55*a* rotates clockwise, the pinion supporter 55*b* slides to a position in the oblong hole 61*c* possible to press the swingable lever 51*a* of the interlock switch 51, and presses thereof, so that the interlock switch 51 is turned on.

When the upper cover 40 and the reversing unit cover 41 are closed, the interlock switch 51 is then turned on as mentioned heretofore, and one of those is then open, for example the reversing unit cover 41 is opened as shown in FIG. 11, the pressure applied to the lever 54*b* by the unit cover use striker 41*a* is released. Then, in accordance with the releasing of the lever 54*b*, the second rack 54 moves to the other one of sides in the longitudinal direction under the bias force F2 of the second bias member 57.

At this moment, since the pinion 55*a* rotates counter clockwise in the drawing meshing with the meshing section 54*e* of the second rack 54, the pinion supporter 55*b* moves to one of sides in the longitudinally within the oblong hole 61*c*.

Consequently, the pressure applied to the swingable lever 51*a* by the pinion supporter 55*b* is released, and the interlock switch 51 is thereby turned off.

When the reversing unit cover 41 is opened, a similar operation as mentioned above with regard to the upper cover 40 is executed although a rotational direction of the pinion 55*a* is different.

In this way, when both the upper and reversing unit covers 40 and 41 are closed, and one of them is then open, the interlock switch 51 is turned off.

As mentioned heretofore, according to this embodiment, since the rack actuation mechanism 90 is provided to move the first rack 73 in the longitudinal direction in conjunction with opening and closing of the upper cover 40, the first rack 73 moves in the longitudinal direction when the actuation gear 90*a* meshes with the rack gear 73*f* and rotates, and the second rack 54 moves in the same direction when the unit cover use striker presses the lever 54*b* arranged at one end in the longitudinal direction.

As a result, in addition to the advantage obtained in the first embodiment, the interlock system 70 can be advantageously operated in conjunction with opening and closing of both covers even when those are openable and closable on planes arranged perpendicular to each other, such as the upper and reversing use covers 40 and 41.

Further, different from the above-mentioned embodiments, the interlock switch 51 can be secured to the apparatus body 1*a* other than the boss section 61*d*.

ADVANTAGE

According to one embodiment of the present invention, a single interlock switch capable of detecting opening and closing of plural covers with a simple mechanism at low cost while avoiding complex designation of conditions and strict controlling of parts tolerance can be obtained.

Numerous additional modifications and variations of the present invention are possible in latent image of the above teachings. It is therefore to be understood that within the scope of the appended claims, the present invention may be practiced otherwise that as specifically described herein.

What is claimed is:

1. An interlock system for turning on and off an interlock switch in conjunction with opening and closing of first and second covers, said interlock system comprising:

a first rack movable in a longitudinal direction between opening and closing positions in conjunction with opening and closing of the first cover, respectively;

a second rack arranged in parallel to the first rack and movable in a longitudinal direction between opening and closing positions in conjunction with opening and closing of the second cover, respectively;

a housing to slidably accommodate the first and second racks in the longitudinal direction; and a pinion unit sandwiched by the first and second racks, wherein said first and second racks have meshing sections respectively meshing with the pinion unit at opposed side surfaces extending in the longitudinal direction facing each other, wherein said pinion unit slides in the longitudinal direction by a prescribed length in conjunction with movement of at least one of the first and second racks, and turns said interlock switch on and off in accordance with a sliding length of the pinion unit in the longitudinal direction.

2. The interlock system as claimed in claim 1, wherein said pinion unit includes a pinion to directly mesh with the meshing sections of the first and second racks, said pinion unit further including a pinion supporter to rotatably support the pinion, and wherein said housing includes a pinion slider to slidably support the pinion supporter in the longitudinal direction.

3. The interlock system as claimed in claim 1, further comprising:

a first bias member to engage the first rack and the housing and bias the first rack toward the opening position thereof; and a second bias member to engage the second rack and the housing and bias the second rack toward the opening position thereof, wherein said first and second racks move against bias forces of the first and second bias members in the longitudinal direction, respectively, when both the first and second covers are closed.

4. The interlock system as claimed in claim 3, wherein said first and second racks include engaging sections to engage inner wall surfaces of the housing at their opening positions, respectively.

5. The interlock system as claimed in claim 1, wherein said interlock switch is secured to the housing.

6. The interlock system as claimed in claim 1, wherein said first and second covers respectively include at least two pressing sections protruding therefrom toward an apparatus body, said first and second racks including levers at their one ends in the longitudinal direction to be pressed by the at least two pressing sections of the first and second covers, respectively, in conjunction with closing of the first and second covers, and wherein said first and second covers are closed on a flat plane.

7. An image forming apparatus comprising:

at least two image bearers;

an optical scanner to form latent images on the at least two image bearers by scanning the at least two image bearers, separately;

at least two developing devices to separately developing and visualize the latent images on the at least two image bearers;

a transfer device to transfer the visualized images from the at least two image bearers and superimpose the visualized images on a transfer medium; and an interlock system as claimed in claim 6, wherein the first and second covers are disposed on the apparatus body.

8. The image forming apparatus as claimed in claim 7, further comprising through-holes to permit the pressing sections to penetrate into the apparatus body and press the levers, respectively, when the first and second covers are closed.

9. The interlock system as claimed in claim 1, wherein said first and second covers respectively include at least two pressing sections protruding therefrom toward an apparatus body; and wherein said housing includes a rack actuation mechanism to move one of the first and second racks in the longitudinal direction in conjunction with opening and closing of one of the first and second covers, said rack actuation mechanism including, a cam pressed by one of the at least two pressing sections of said one of the first and second covers in conjunction with a closing motion thereof, and a gear integral with the cam to simultaneously rotate with the cam to move said one of the first and second racks in the longitudinal direction when the cam is pressed;

a rack actuation meshing section provided in one of the first and second racks to mesh with the gear at a side opposite the one side meshing with the pinion; and a lever provided in the other one of the first and second racks at one end in the longitudinal direction thereof to be pressed by the other one of the at least two pressing sections in conjunction with closing of the other one of the first and second covers, wherein the other one of the first and second racks moves in the longitudinal direction when the lever is pressed, and wherein the first and second covers are closed on a perpendicular plane.

10. The interlock system as claimed in claim 1, wherein said interlock switch is turned on by the pinion unit sliding in the longitudinal direction together with the first and second racks when both the first and second covers are closed together, and wherein said interlock switch is turned off by the pinion unit sliding in the longitudinal direction when any one of the first and second covers opens.

11. The interlock system as claimed in claim 1, wherein said interlock switch is composed of a micro switch.

12. The interlock system as claimed in claim 11, wherein said micro switch includes a swingably flexible lever movable between turn on and off positions when pressed and released by the pinion unit sliding in the longitudinal direction, respectively, wherein bias forces of said first and second bias members are greater than a retuning force of the swingably flexible lever.

* * * * *